US009898973B2

(12) United States Patent
Takasaki et al.

(10) Patent No.: US 9,898,973 B2
(45) Date of Patent: Feb. 20, 2018

(54) DISPLAY DEVICE, ELECTRONIC APPARATUS AND METHOD OF DRIVING DISPLAY DEVICE

(71) Applicant: Japan Display Inc., Minato-ku (JP)

(72) Inventors: Naoyuki Takasaki, Minato-ku (JP); Kazuhiko Sako, Minato-ku (JP); Tsutomu Harada, Minato-ku (JP)

(73) Assignee: Japan Display Inc., Minato-ku (JP)

( * ) Notice: Subject to any disclaimer, the term of this patent is extended or adjusted under 35 U.S.C. 154(b) by 120 days.

(21) Appl. No.: 15/084,523

(22) Filed: Mar. 30, 2016

(65) Prior Publication Data

US 2016/0300522 A1 Oct. 13, 2016

(30) Foreign Application Priority Data

Apr. 13, 2015 (JP) ..... 2015-081611

(51) Int. Cl.
*G09G 5/00* (2006.01)
*G09G 3/34* (2006.01)

(52) U.S. Cl.
CPC ..... *G09G 3/342* (2013.01); *G09G 2320/0285* (2013.01); *G09G 2320/0646* (2013.01); *G09G 2330/023* (2013.01); *G09G 2360/16* (2013.01)

(58) Field of Classification Search
CPC ..... G09G 3/342; G09G 2320/0285; G09G 2320/0646; G09G 2360/16; G09G 2330/023
See application file for complete search history.

(56) References Cited

U.S. PATENT DOCUMENTS

2011/0181635 A1 7/2011 Kabe et al.
2013/0027383 A1* 1/2013 Odawara ..... G09G 3/3233 345/212
2015/0221268 A1 8/2015 Kabe et al.

FOREIGN PATENT DOCUMENTS

| | | |
|---|---|---|
| JP | 9-106458 | 4/1997 |
| JP | 9-149257 | 6/1997 |
| JP | 2011-154323 | 8/2011 |
| JP | 2013-195605 | 9/2013 |
| JP | 2014-10633 | 1/2014 |
| JP | 2015-82020 | 4/2015 |

* cited by examiner

*Primary Examiner* — Adam R Giesy
(74) *Attorney, Agent, or Firm* — Oblon, McClelland, Maier & Neustadt, L.L.P.

(57) ABSTRACT

The signal processing unit 20 includes a pixel index value calculating unit that calculates a pixel index value based on an input signal for each pixel 48, a chunk determining unit that performs consecutiveness determination which determines whether or not a pixel 48, having a pixel index value between an upper boundary value and a lower boundary value is consecutive from the starting pixel, and determines consecutive pixels as a chunk, a chunk index value calculating unit that calculates a chunk index value, a region index value calculating unit that calculates a region index value of a target region, and a light irradiation amount deciding unit that compares the chunk index value with the region index value, and decides the irradiation amount of the light of the light source unit in the target region based on the one by which the irradiation amount of the light is increased.

13 Claims, 23 Drawing Sheets

DISPLAY DEVICE, ELECTRONIC APPARATUS AND METHOD OF DRIVING DISPLAY DEVICE

CROSS-REFERENCE TO RELATED APPLICATIONS

This application claims priority from Japanese Application No. 2015-081611, filed on Apr. 13, 2015, the contents of which are incorporated by reference herein in its entirety.

BACKGROUND

1. Technical Field

The present disclosure relates to a display device, an electronic apparatus, and a method of driving a display device.

2. Description of the Related Art

In recent years, the demand for display devices for mobile apparatuses such as mobile phones and electronic paper has been increased. In the display devices, one pixel includes a plurality of sub-pixels that output light of different colors, and various colors are displayed through one pixel by switching ON and OFF of display of the sub-pixels. In the display devices, display characteristics such as resolution and luminance have been improved year after year as well. However, since an aperture ratio decreases as resolution increases, it is necessary to increase luminance of a backlight in order to implement high luminance, which leads to an increase in power consumption of the backlight.

In order to solve this problem, a technique that adds a white sub-pixel serving as a fourth sub-pixel to red, green, and blue sub-pixels known in the art has been proposed. According to this technique, a current value of the backlight is reduced as the white sub-pixel enhances the luminance, and thus the power consumption is reduced.

To reduce the luminance of the backlight, there is a method of performing image analysis, reducing the luminance of the backlight based on luminance and saturation of an image and reducing power consumption. In this case, when the image is determined to be high in neither luminance nor saturation as an analysis result of input signals of the image, the luminance of the backlight is reduced. However, there are cases in which even in the image determined to be high in neither luminance nor saturation, when the luminance of the backlight is reduced, a deterioration in a display quality is recognized.

SUMMARY

According to an aspect, a display device includes an image display panel including a plurality of pixels arranged in a matrix form, a light source unit that irradiates the image display panel with light and a signal processing unit that controls the pixels based on an input signal of an image, and controls an irradiation amount of light of the light source unit. The signal processing unit includes a pixel index value calculating unit that calculates a pixel index value serving as an index for obtaining the irradiation amount of the light emitted from the light source unit based on the input signal for each pixel, a chunk determining unit that performs consecutiveness determination which determines whether or not a pixel, having a pixel index value between an upper boundary value larger than a pixel index value of a starting pixel and a lower boundary value smaller than the pixel index value of the starting pixel, is consecutive from the starting pixel, and determines a region of consecutive pixels as a chunk, a chunk index value calculating unit that calculates a chunk index value serving as an index value of the chunk based on the pixel index values of the pixels of the chunk, a region index value calculating unit that calculates a region index value serving as an index value of an entire target region based on the pixel index values of all the pixels of the target region, and a light irradiation amount deciding unit that compares the chunk index value with the region index value, and decides the irradiation amount of the light of the light source unit in the target region based on one of the chunk index value and the region index value by which the irradiation amount of the light is increased.

DETAILED DESCRIPTION

Figure 1:
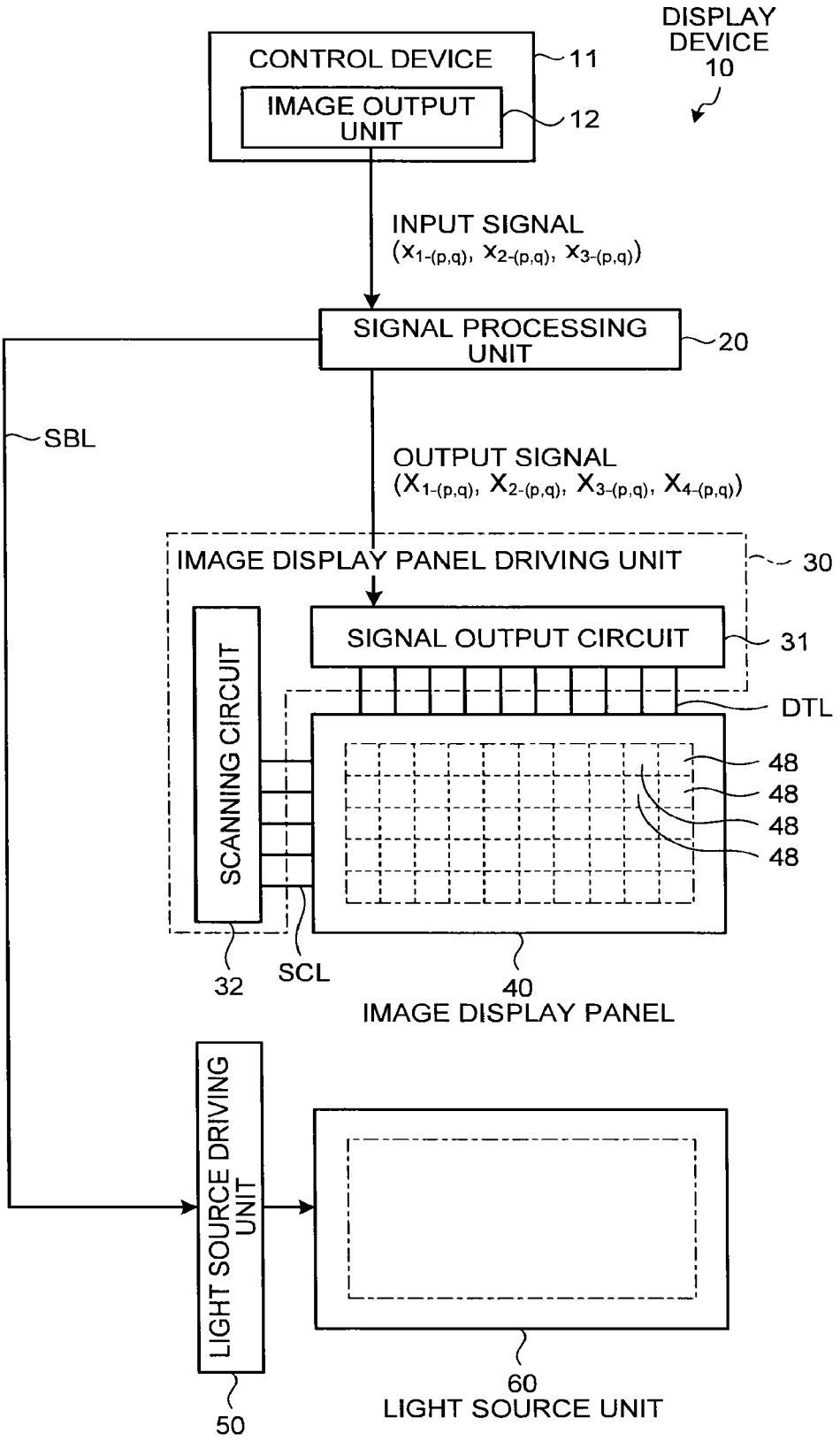
FIG. 1 is a block diagram illustrating an exemplary configuration of a display device according to a first embodiment.

Hereinafter, exemplary embodiments of the present invention will be described with reference to the accompanying drawings. The disclosure is given by way of example, and modifications that maintain the gist of the present invention and are easily conceivable by those skilled in the art are included in the present invention. To further clarify the description, the width, thickness, shape, and the like of each component may be schematically illustrated in the drawings as compared to actual aspects, and they are given by way of example and interpretation of the present invention is not limited to them. The same elements as those described in the description with reference to some drawings are denoted by the same reference numerals through the description and the drawings, and detailed descriptions thereof will be omitted in some cases.

First Embodiment

Overall Configuration of Display Device

Figure 2:
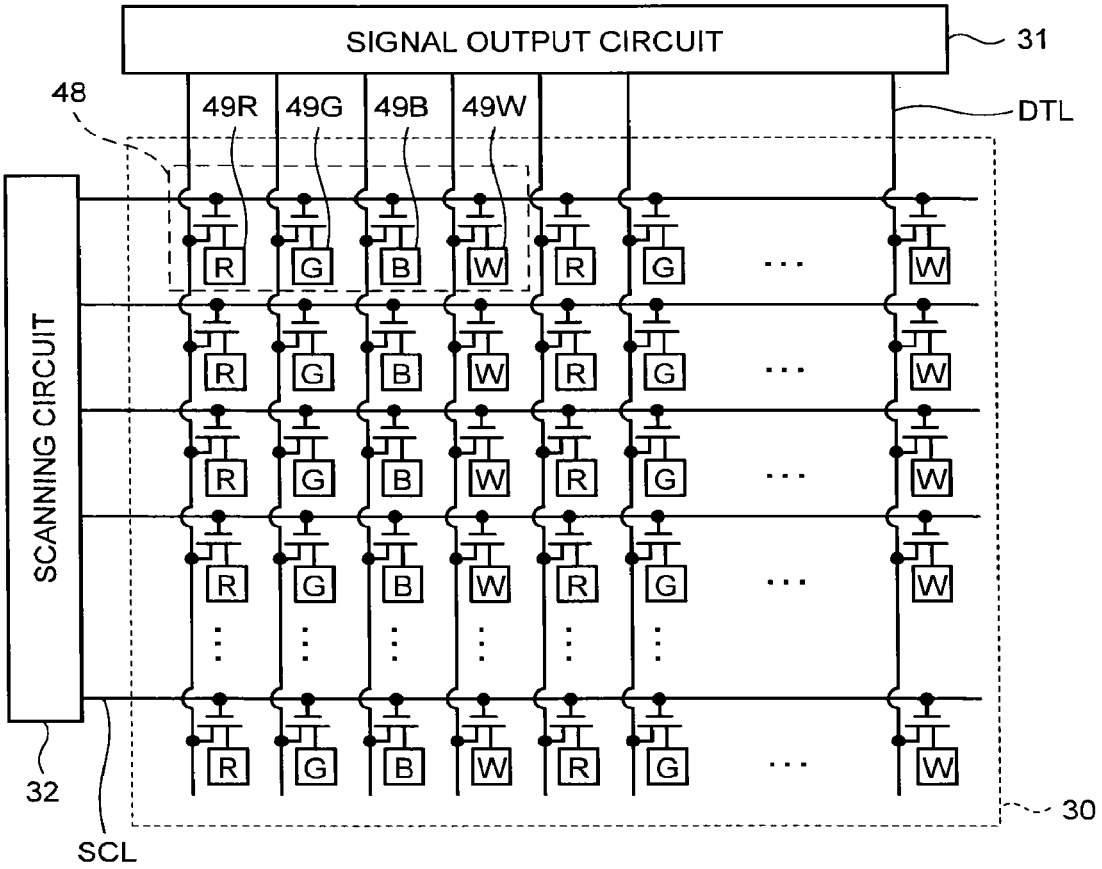
FIG. 2 is a conceptual diagram of an image display panel according to the first embodiment.

FIG. 1 is a block diagram of an exemplary configuration of a display device according to a first embodiment of the present invention. FIG. 2 is a conceptual diagram of an image display panel according to the first embodiment. As illustrated in FIG. 1, a display device 10 according to the first embodiment includes a signal processing unit 20, an image display panel driving unit 30, an image display panel 40, a light source driving unit 50, and a light source unit 60. The signal processing unit 20 receives an input signal (RGB data) from an image output unit 12 of a control device 11, and transfers a signal generated by performing a predetermined data conversion process on the input signal to the respective units of the display device 10. The image display panel driving unit 30 controls driving of the image display panel 40 based on the signal received from the signal processing unit 20. The light source driving unit 50 controls driving of the light source unit 60 based on the signal received from the signal processing unit 20. The light source unit 60 illuminates the back surface of the image display panel 40 with light based on the signal received from the light source driving unit 50. The image display panel 40 displays an image based on the signal received from the image display panel driving unit 30 and the light emitted from the light source unit 60.

Configuration of Image Display Panel

First, a configuration of the image display panel 40 will be described. The image display panel 40 includes $P_0 \times Q_0$ pixels 48 ($P_0$ pixels in the row direction and $Q_0$ pixels in the column direction) arranged in a two-dimensional (2D) matrix form as illustrated in FIGS. 1 and 2. FIG. 1 illustrates an example in which a plurality of pixels 48 are arranged on a 2D XY coordinate system in the matrix form. In this example, an X direction is the horizontal direction (the row direction), and a Y direction is the vertical direction (the column direction), and the present invention is not limited thereto, and the X direction may be the vertical direction, and the Y direction may be the horizontal direction.

Each of the pixels 48 includes a first sub-pixel 49R, a second sub-pixel 49G, a third sub-pixel 49B, and a fourth sub-pixel 49W. The first sub-pixel 49R displays a first color (for example, red). The second sub-pixel 49G displays a second color (for example, green). The third sub-pixel 49B displays a third color (for example, blue). The fourth sub-pixel 49W displays a fourth color (for example, white). The first, the second, the third, and the fourth colors are not limited to red, green, blue, and white, respectively, and simply need only to be different from one another, such as complementary colors. The fourth sub-pixel 49W that displays the fourth color preferably has higher luminance than that of the first sub-pixel 49R that displays the first color, the second sub-pixel 49G that displays the second color, and the third sub-pixel 49B that displays the third color when they are irradiated with light with the same light source lighting amount. In the following description, when it is unnecessary to distinguish the first sub-pixel 49R, the second sub-pixel 49G, the third sub-pixel 49B, and the fourth sub-pixel 49W, they are referred to as a "sub-pixel 49." To distinguish and specify a position at which a sub-pixel is arranged, for example, a fourth sub-pixel in a pixel $\mathbf{48}_{(p,q)}$ is referred to as a "fourth sub-pixel $\mathbf{49}W_{(p,q)}$."

The image display panel 40 is a color liquid crystal display panel in which a first color filter passing the first color is arranged between the first sub-pixel 49R and an image observer, a second color filter passing the second color is arranged between the second sub-pixel 49G and the image observer, and a third color filter passing the third color is arranged between the third sub-pixel 49B and the image observer. In the image display panel 40, no color filter is arranged between the fourth sub-pixel 49W and the image observer. The fourth sub-pixel 49W may be provided with transparent resin layer instead of the color filter. By arranging the transparent resin layer in this way, the image display panel 40 can suppress a large step difference of the fourth sub-pixel 49W which occurs when no color filter is arranged on the fourth sub-pixel 49W.

Configuration of Image Display Panel Driving Unit

The image display panel driving unit 30 includes a signal output circuit 31 and a scanning circuit 32 as illustrated in FIGS. 1 and 2. The image display panel driving unit 30 holds video signals in the signal output circuit 31 and sequentially outputs the video signals to the image display panel 40. More specifically, the signal output circuit 31 outputs an image output signal having a certain electric potential corresponding to the output signal from the signal processing unit 20 to the image display panel 40. The signal output circuit 31 is electrically connected to the image display panel 40 through signal lines DTL. The scanning circuit 32 controls an ON/OFF operation of a switching element (for example, a thin-film transistor (TFT)) that controls an operation (light transmittance) of the sub-pixel 49 in the image display panel 40. The scanning circuit 32 is electrically connected to the image display panel 40 through wirings SCL.

Configurations of Light Source Driving Unit and Light Source Unit

Figure 3:
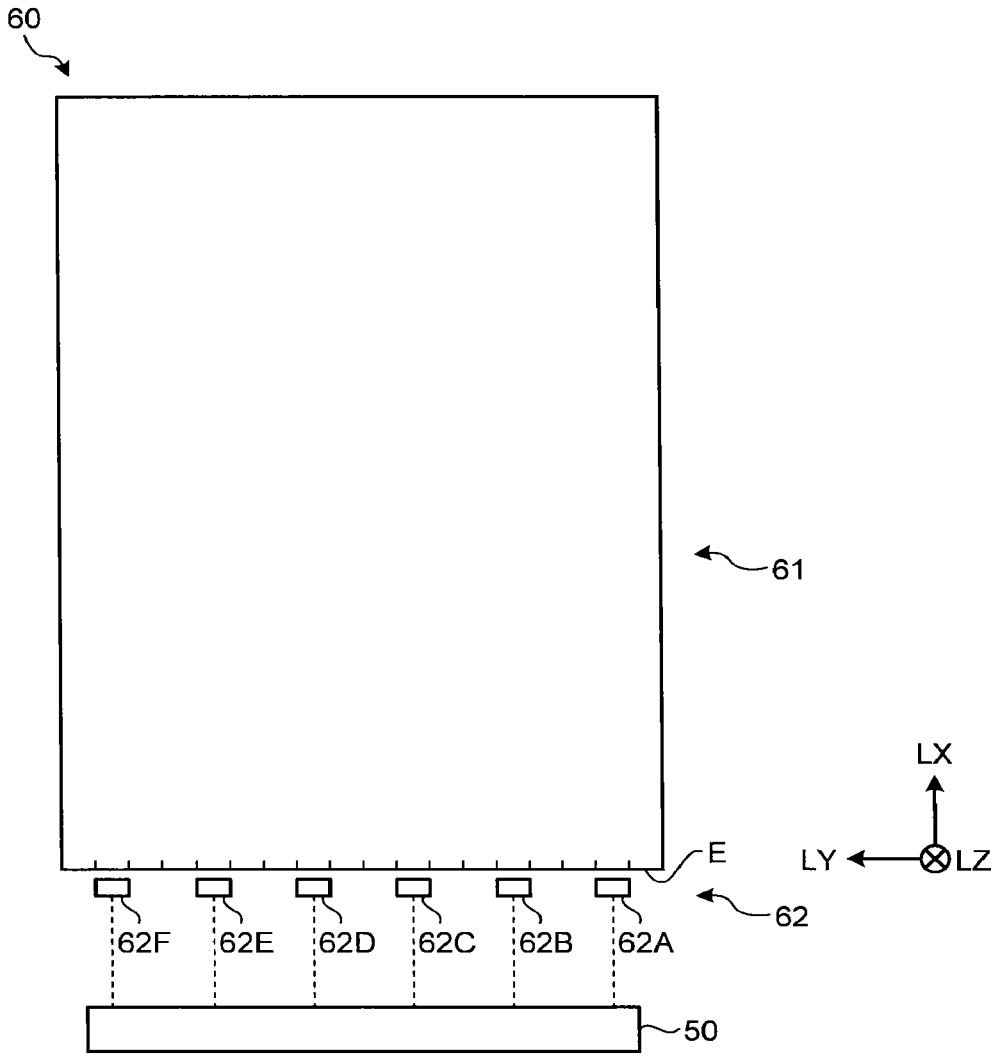
FIG. 3 is an explanatory diagram of a light source unit according to the present embodiment.

The light source unit 60 (light source unit) is arranged on the back surface of the image display panel 40, and emits light toward the image display panel 40 and illuminates the image display panel 40 with light. FIG. 3 is an explanatory diagram of the light source unit according to the present embodiment. The light source unit 60 includes a light guide plate 61 and a sidelight light source 62 having at least one side surface of the light guide plate 61 as an incidence surface E. The sidelight light source 62 includes a plurality of light sources 62A, 62B, 62C, 62D, 62E, and 62F arranged facing the incidence surface E. The light sources 62A to 62F, for example, are light-emitting diodes (LEDs) of the same color (for example, white). The light sources 62A to 62F are arranged along one side surface of the light guide plate 61, and when a light source arrangement direction in which the light sources 62A to 62F are arranged is indicated by LY, incident light of the light sources 62A to 62F enter the light guide plate 61 through the entrance surface E in a light entrance direction LX orthogonal to the light source arrangement direction LY. Hereinafter, when it is unnecessary to distinguish the light sources 62A to 62F, they are referred to as a "light source 62."

The light source driving unit 50 controls the amount of light output from the light source unit 60, for example. Specifically, the light source driving unit 50 adjusts an electric current supplied to the light source unit 60 or the duty ratio based on a surface light source device control signal SBL output from the signal processing unit 20, and controls the irradiation amount of light (intensity of light) with which the image display panel 40 is irradiated. The light source driving unit 50 can performs light source divisional drive control of controlling the amount of light (intensity of light) output from the light sources 62A to 62F by controlling the electric current or the duty ratio for the light sources 62A to 62F illustrated in FIG. 3 individually and independently.

In the light guide plate 61, since light is reflected at both end surfaces in the light source arrangement direction LY, for example, an intensity distribution of light emitted from the light sources 62A and 62F arranged closer to both end surfaces in the light source arrangement direction LY is different from an intensity distribution of light emitted from the light source 62C arranged between the light sources 62A and 62F. For this reason, the light source driving unit 50 according to the present embodiment needs to control the electric current or the duty ratio for the light sources 62A to 62F illustrated in FIG. 3 individually and independently and control a quantity of light (intensity of light) be to emitted according to the light intensity distributions of the light sources 62A to 62F.

In the light source unit 60, incident light from the light sources 62A to 62F is emitted in the light entrance direction LX orthogonal to the light source arrangement direction LY and enters the light guide plate 61 through the entrance surface E. The light incident on the light guide plate 61 travels in the incidence direction LX while diffusing. The light guide plate 61 irradiates with the light that has been emitted from the light sources 62A to 62F and incident thereon in the illumination direction LZ in which the image display panel 40 is illuminated from the back surface. In the present embodiment, the illumination direction LZ is orthogonal to the light source arrangement direction LY and the light entrance direction LX.

Figure 4:
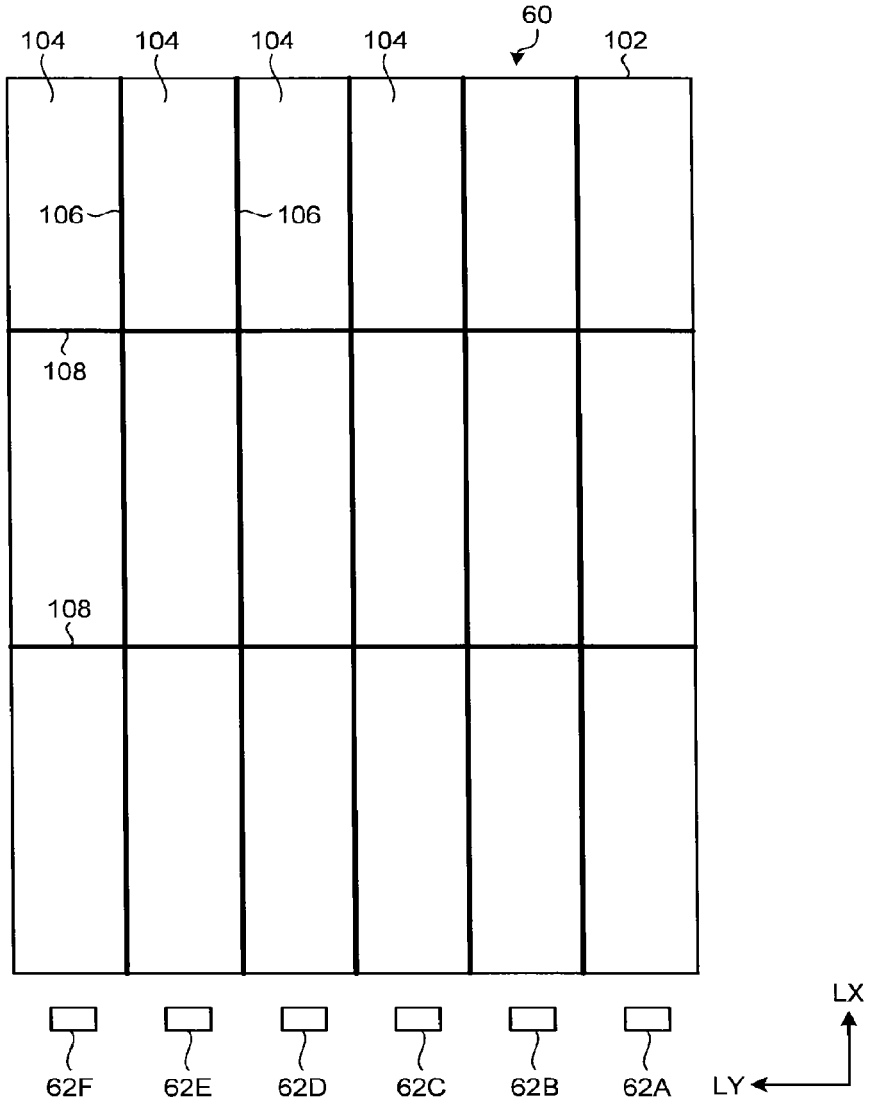
FIG. 4 is a schematic diagram illustrating a region of an emission surface of a light source unit.

FIG. 4 is a schematic diagram illustrating regions on an emission surface of the light source unit. In the display device 10 according to the present embodiment, an emission surface 102 serving as a surface from which the light source unit 60 emits light towards an image display surface serving as a surface on which the image display panel 40 displays an image is virtually divided into a plurality of regions 104. The regions 104 are divided in a matrix form by a plurality of parting lines 106 parallel to the light entrance direction LX and a plurality of parting lines 108 parallel to the light source arrangement direction LY. Each of the parting lines 106 is formed between two adjacent light sources among the light sources 62A to 62F. Thus, the five parting lines 106 are formed at equal intervals. The regions 104 are regions corresponding to the light sources 62A to 62F. The two parting lines 108 are formed at equal intervals. Thus, the emission surface 102 is divided into the 18 regions 104 in a 3×6 matrix form. The number of divided regions 104 is not particularly limited thereto, but it is desirable to perform the division in the light source arrangement direction LY according to an arrangement of the light sources. This makes it easy to control the outputs of the respective light sources. The display device 10 sets one of the regions 104 as a target region, and calculates a region light irradiation value $1/\alpha$ (which will be described later) for each target region. The target region includes the region 104 and a region of the image display surface of the image display panel 40 with which light is emitted from the region 104. The region of the image display surface is a portion region of the entire image display surface of the image display panel 40, and includes the pixels 48 within the region. Since the number of regions 104 is arbitrary as described above, one region may occupy the entire emission surface 102 as the region 104, and one region may occupy the entire region of the image display surface as the region of the image display surface corresponding to the region 104.

Configuration of Signal Processing Unit

The signal processing unit 20 processes an input signal received from the control device 11, and generates an output signal. The signal processing unit 20 converts an input value of the input signal displayed by combining red (the first color), green (the second color), and blue (the third color) into an extended value (output signal) in an extended color space (a HSV (Hue-Saturation-Value, Value is also called Brightness) color space in the first embodiment) extended by red (first color), green (second color), blue (third color), and white (fourth color), and generates the output value. The signal processing unit 20 outputs the generated output signal to the image display panel driving unit 30. The extended color space will be described later. While the extended color space according to the first embodiment is the HSV color space, it is not limited thereto, and any other coordinate system such as an XYZ color space and a YUV color space may be the extended color space. The signal processing unit 20 also generates the light source control signal SBL to be output to the light source driving unit 50.

Figure 5:
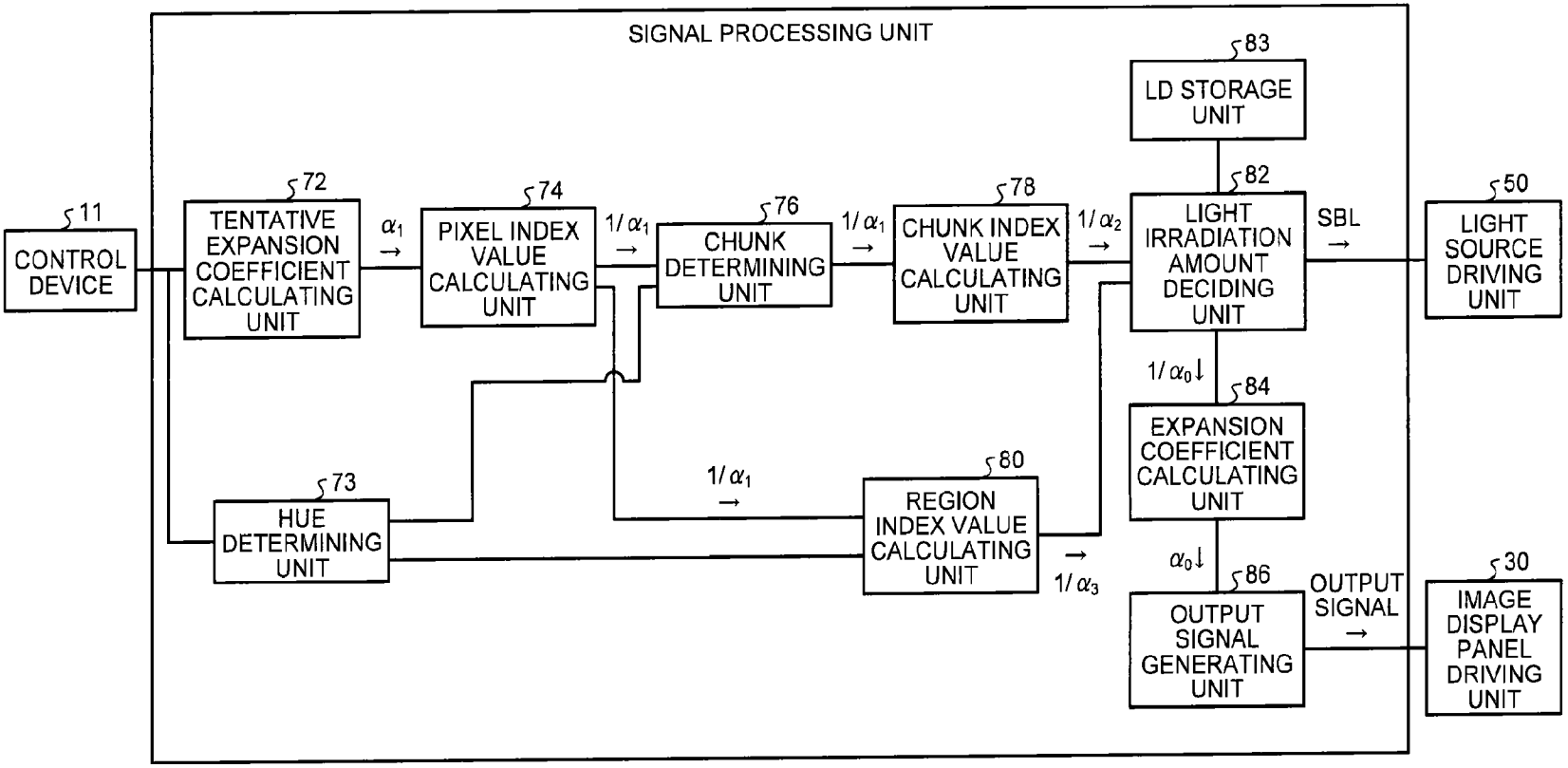
FIG. 5 is a block diagram illustrating an overview of a configuration of a signal processing unit according to the first embodiment.

FIG. 5 is a block diagram illustrating an overview of a configuration of the signal processing unit according to the first embodiment. The signal processing unit 20 includes a tentative expansion coefficient calculating unit 72, a hue determining unit 73, a pixel index value calculating unit 74, a chunk determining unit 76, a chunk index value calculating unit 78, a region index value calculating unit 80, a light irradiation amount deciding unit 82, an expansion coefficient calculating unit 84, and an output signal generating unit 86 as illustrated in FIG. 5. The respective units of the signal processing unit 20 may be independent units (circuits or the like) or may be a common unit.

The tentative expansion coefficient calculating unit 72 acquires the input signal of the image from the control device 11, and calculates a tentative expansion coefficient $\alpha_1$ serving as a tentative coefficient for expanding the input signal for each pixel 48. The tentative expansion coefficient calculating unit 72 calculates the tentative expansion coefficient $\alpha_1$ for all the pixels 48 of the image display panel 40.

The tentative expansion coefficient calculating unit 72 calculates saturation and value (also called as brightness) of a color to be displayed based on the input signal for each pixel 48, and calculates the tentative expansion coefficient $\alpha_1$ based on the calculated saturation and brightness. A method of calculating the tentative expansion coefficient $\alpha_1$ through the tentative expansion coefficient calculating unit 72 will be described later.

The hue determining unit 73 determines a hue of each pixel based on the input signal.

The pixel index value calculating unit 74 acquires information of the tentative expansion coefficient $\alpha_1$ of each pixel 48 from the tentative expansion coefficient calculating unit 72. The pixel index value calculating unit 74 calculates a pixel index value $1/\alpha_1$ for each pixel 48 based on the tentative expansion coefficient $\alpha_1$ of each pixel 48. The pixel index value calculating unit 74 calculates the pixel index value $1/\alpha_1$ for all the pixels 48 of the image display panel 40. The pixel index value $1/\alpha_1$ is an index for obtaining an irradiation amount of light emitted from the light source unit 60. In the first embodiment, as the value of the pixel index value $1/\alpha_1$ increases, the light source lighting amount of the light source unit 60 increases (the reduction rate of the irradiation amount of light decreases). And as the value of the pixel index value $1/\alpha_1$ decreases, the light source lighting amount of the light source unit 60 decreases (the reduction rate of the irradiation amount of light increases). The value of the pixel index value $1/\alpha_1$ is $1/\alpha_1$. In other words, a value of the pixel index value $1/\alpha_1$ of a certain pixel 48 is a reciprocal of the tentative expansion coefficient $\alpha_1$ in the pixel 48.

The chunk determining unit 76 acquires information of the pixel index value $1/\alpha_1$ of the pixel 48 from the pixel index value calculating unit 74, and acquires information of the hue of the pixel 48 from the hue determining unit 73. The chunk determining unit 76 performs consecutiveness determination which determines whether or not a starting pixel 48*s* selected from among all the pixels 48 is consecutive to another pixel 48 based on the pixel index value $1/\alpha_1$ and the hue information. The chunk determining unit 76 determines a region of the consecutive pixels to be a chunk. The starting pixel 48*s* is a pixel serving as a starting point when the consecutiveness determination is performed. The chunk determining unit 76 selects a pixel, of which the pixel index value $1/\alpha_1$ is a predetermined value or more, as the starting pixel 48*s* from among all the pixels 48. The chunk determining unit 76 may arbitrarily select the starting pixel 48*s* from among all the pixels 48 without deciding a predetermined value. The chunk determining unit 76 determines the region of the pixels determined to be consecutive in the consecutiveness determination as a chunk. The chunk can be indicated to be a pixel group comprised of a plurality of pixels 48 determined to be consecutive in the consecutiveness determination. The chunk determining unit 76 may use or may not use the hue information of the hue determining unit 73. The consecutiveness determination method performed by the chunk determining unit 76 will be described later in detail.

The chunk index value calculating unit 78 acquires information of the pixel index value $1/\alpha_1$ of each pixel 48 in the chunk determined by the chunk determining unit 76. The chunk index value calculating unit 78 calculates a chunk index value $1/\alpha_2$ serving as an index value of the chunk based on the information of the pixel index value $1/\alpha_1$ of each pixel 48 in the chunk. The chunk index value $1/\alpha_2$ is an index for obtaining the irradiation amount of light of the light source unit 60 in the pixel 48 configuring the chunk. A process of calculating the chunk index value $1/\alpha_2$ through the chunk index value calculating unit 78 will be described later in detail.

The region index value calculating unit 80 acquires the information of the pixel index value $1/\alpha_1$ in the pixel 48 in the target region from the pixel index value calculating unit 74, and acquires the hue information of the pixel 48 in the target region from the hue determining unit 73. The region index value calculating unit 80 calculates a region index value $1/\alpha_3$ serving as an index value of the entire region in the target region based on the information of the pixel index value $1/\alpha_1$ and the hue information. The region index value $1/\alpha_3$ is an index that is used to obtain the irradiation amount of light of the light source unit 60 to the target region and common to all the pixels 48 in the target region. The region index value calculating unit 80 may use or may not use the hue information of the hue determining unit 73. A process of calculating the region index value $1/\alpha_3$ through the region index value calculating unit 80 will be described later in detail.

The light irradiation amount deciding unit 82 acquires information of the chunk index value $1/\alpha_2$ from the chunk index value calculating unit 78, and acquires information of the region index value $1/\alpha_3$ from the region index value calculating unit 80. The light irradiation amount deciding unit 82 compares the value of the chunk index value $1/\alpha_2$ with the value of the region index value $1/\alpha_3$ in the target region, and decides the irradiation amount of light of the light source unit 60 in the target region based on the value by which the irradiation amount of light of the light source unit 60 is increased. Specifically, the light irradiation amount deciding unit 82 uses one of the value of the chunk index value $1/\alpha_2$ in the target region and the value of the region index value $1/\alpha_3$ in the target region, that is, the value by which the irradiation amount of light of the light source unit 60 is increased, as the region light irradiation value $1/\alpha$. The region light irradiation value $1/\alpha$ is a value indicating the irradiation amount of light of the light source unit 60. As the value of the region light irradiation value $1/\alpha$ increases, the light source lighting amount of the light source unit 60 increases (the reduction rate of the irradiation amount of light decreases). As the value of the region light irradiation value $1/\alpha$ decreases, the light source lighting amount of the light source unit 60 decreases (the reduction rate of the irradiation amount of light increases).

An LD storage unit 83 stores information of luminance distribution information LD of each light source 62 of the light source unit 60. As described above, the light sources 62 differ in the intensity distribution (luminance distribution) of light emitted therefrom. The luminance distribution information LD indicates information of a luminance distribution of each light source 62. The light irradiation amount deciding unit 82 decides a region lighting amount $1/\alpha'$ serving as a lighting amount of each light source of the light source unit 60 based on the region light irradiation value $1/\alpha$ and the luminance distribution information LD. The light irradiation amount deciding unit 82 outputs information of the region lighting amount $1/\alpha'$ to the light source driving unit 50 as the light source control signal SBL.

The light irradiation amount deciding unit 82 calculates a pixel light irradiation amount $1/\alpha_0$ based on the region lighting amount $1/\alpha'$. The pixel light irradiation amount $1/\alpha_0$ is an irradiation amount of light with which the light source unit 60 irradiates each pixels 48. The expansion coefficient calculating unit 84 acquires the information of the pixel light irradiation amount $1/\alpha_0$ from the light irradiation amount deciding unit 82. The expansion coefficient calculating unit 84 calculates an expansion coefficient $\alpha_0$ for expanding the input signal of the pixel 48 in the target region based on the value of the pixel light irradiation amount $1/\alpha_0$.

The output signal generating unit 86 acquires information of the expansion coefficient $\alpha_0$ from the expansion coefficient calculating unit 84. The output signal generating unit 86 generates an output signal for causing the pixel 48 in the target region to display a predetermined color based on the value of the expansion coefficient $\alpha_0$ and the input signal. The output signal generating unit 86 outputs the generated output signal to the image display panel driving unit 30. A process of generating the output signal through the output signal generating unit 86 will be described later.

Process Operations of Display Device

Pixel Index Value Calculation Process

Figure 6:
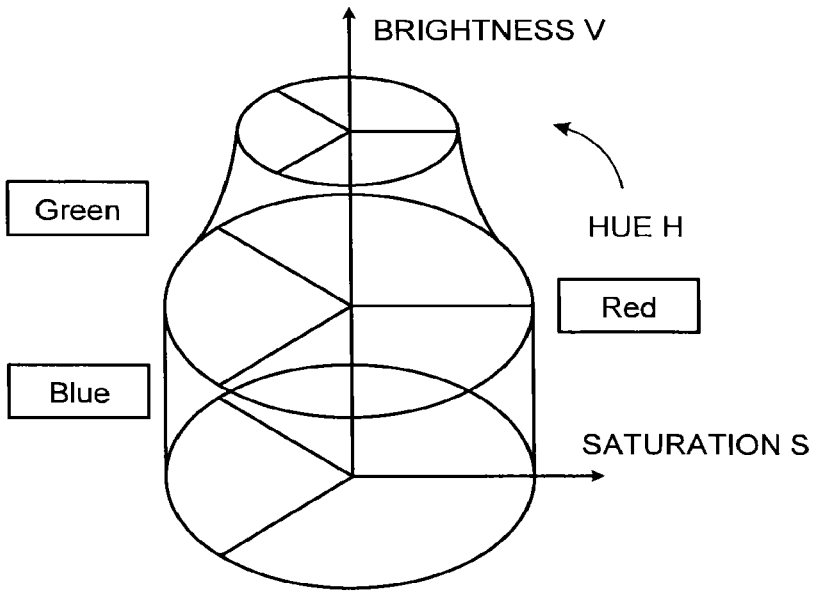
FIG. 6 is a conceptual diagram of an extended HSV color space that is extendable by the display device according to the present embodiment.
Figure 7:
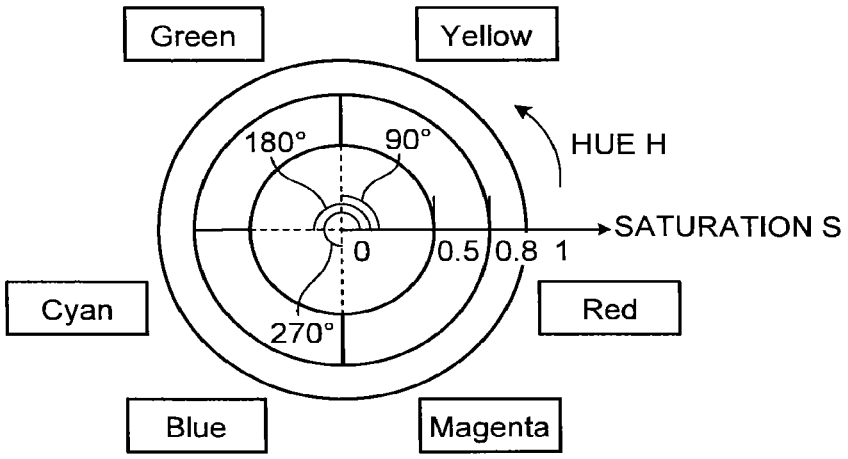
FIG. 7 is a conceptual diagram illustrating a relation between a hue and saturation of an extended HSV color space.

Next, a process of calculating the pixel index value $1/\alpha_1$ among process operations of the display device 10 will be described. The pixel index value $1/\alpha_1$ is calculated based on the tentative expansion coefficient $\alpha_1$ as described above. FIG. 6 is a conceptual diagram of an extended HSV color space that is extendable by the display device of the present embodiment. FIG. 7 is a conceptual diagram a relation between a hue and saturation of the extended HSV color space.

In the display device 10, each of the pixels 48 includes the fourth sub-pixel 49W that outputs the fourth color (white), and thus the dynamic range of brightness is increased in the extended color space (the HSV color space in the first embodiment) as illustrated in FIG. 6. In other words, in the extended color space extended by the display device 10, as illustrated in FIG. 6, a solid in which a shape in a cross section having saturation axis and a brightness axis in which as the saturation increases, a maximum value of the brightness decreases is a substantially trapezoidal in which an oblique side is a curve is placed on a cylindrical color space displayable by the first sub-pixel 49R, the second sub-pixel 49G, and the third sub-pixel 49B. The signal processing unit 20 stores therein a maximum value Vmax(S) of the brightness having saturation S as a variable in the extended color space (the HSV color space in the first embodiment) expanded by adding the fourth color (white) is stored in the signal processing unit 20. In other words, the signal processing unit 20 stores the value of the maximum value Vmax(S) of the brightness for each coordinates (values) of the saturation and the hue in the three-dimensional shape of the extended color space illustrated in FIG. 6. Since the input signal is configured with input signals for the first sub-pixel 49R, the second sub-pixel 49G, and the third sub-pixel 49B, the color space of the input signal has a cylindrical shape, that is, the same shape as the cylindrical part of the extended color space.

The tentative expansion coefficient $\alpha_1$ is a tentative value used to expand the input signal and convert the color space by the output signal into the extended color space. In the signal processing unit 20, the tentative expansion coefficient calculating unit 72 obtains the saturation S and the brightness V(S) in the pixel 48 based on the input signal value of the sub-pixel 49 in the pixel 48 in the target region, and calculates the tentative expansion coefficient $\alpha_1$. This will be specifically described below.

The saturation S and the brightness V(S) are indicated by S=(Max−Min)/Max and V(S)=Max. The saturation S can have values of 0 to 1, the brightness V(S) can have values of 0 to $(2^n-1)$, where n is a display gradation bit number. Max is a maximum value among the input signal values of the three sub-pixels in the pixel, that is, the input signal value of the first sub-pixel 49R, the input signal value of the second sub-pixel 49G, and the input signal value of the third sub-pixel 49B. Min is a minimum value among the input signal values of the three sub-pixels in the pixel, that is, of the input signal value of the first sub-pixel 49R, the input signal value of the second sub-pixel 49G, and the input signal value of the third sub-pixel 49B. A hue H is indicated by a range from 0° to 360° as illustrated in FIG. 7. As the hue H varies from 0° to 360°, it sequentially indicates red, yellow, green, cyan, blue, magenta, and red.

The signal processing unit 20 receives the input signal serving as information of the image to be displayed from the control device 11. For each pixel, the input signal includes the information of the image (color) to be displayed at a position of the pixel as the input signal. Specifically, for a (p,q)-th pixel (here, $1 \le p \le I$ and $1 \le q \le Q_0$), a signal including an input signal of the first sub-pixel having the signal value of $x_{1-(p,q)}$, an input signal of the second sub-pixel having the signal value of $x_{2-(p,q)}$, and an input signal of the third sub-pixel having the signal value of $x_{3-(p,q)}$ is input to the signal processing unit 20.

Generally, in the (p,q)-th pixel, saturation $S_{(p,q)}$ and the brightness (value) $V(S)_{(p,q)}$ of an input color in the cylindrical HSV color space are calculated by the following Equations (1) and (2) based on the input signal (the signal value of $x_{1-(p,q)}$) of the first sub-pixel, the input signal (the signal value of $x_{2-(p,q)}$) of the second sub-pixel, and the input signal (the signal value of $x_{3-(p,q)}$) of the third sub-pixel.

$$S_{(p,q)}=(\mathrm{Max}_{(p,q)}-\mathrm{Min}_{(p,q)})/\mathrm{Max}_{(p,q)} \quad (1)$$

$$V(S)_{(p,q)}=\mathrm{Max}_{(p,q)} \quad (2)$$

$\mathrm{Max}_{(p,q)}$ is the maximum value among the input signal values of the three sub-pixels 49, that is, $x_{1-(p,q)}$, $x_{2-(p,q)}$, and $x_{3-(p,q)}$, and $\mathrm{Min}_{(p,q)}$ is the minimum value among the input signal values of the three sub-pixels 49, that is, $x_{1-(p,q)}$, $x_{2-(p,q)}$, and $x_{3-(p,q)}$. In the first embodiment, n is assumed to be 8. That is, the display gradation bit number is 8 bits (the display gradation has 256 gradation values, that is, 0 to 255).

In the signal processing unit 20, the tentative expansion coefficient calculating unit 72 calculates the tentative expansion coefficient $\alpha_1$ using Equation (3) based on the brightness $V(S)_{(p,q)}$ of each pixel 48 in the target region and Vmax(S) of the extended color space. The tentative expansion coefficient $\alpha_1$ may have a different value according to each pixel 48.

$$\alpha_{1(p,q)}=V\mathrm{max}(S)/V(S)_{(p,q)} \quad (3)$$

In the signal processing unit 20, the pixel index value calculating unit 74 calculates a reciprocal of $\alpha_{1(p,q)}$, and uses the calculated reciprocal of $\alpha_{(p,q)}$ as the pixel index value $1/\alpha_{1(p,q)}$ of the (p,q)-th pixel 48. Accordingly, the signal processing unit 20 calculates the pixel index value $1/\alpha_1$ of each pixel 48.

Chunk Index Value Calculation Process

Next, the consecutiveness determination performed by the chunk determining unit 76 and the chunk index value calculation process will be described. In the consecutiveness determination, the chunk determining unit 76 selects the starting pixel 48*s* serving as the starting point at which the consecutiveness determination starts among all the pixels 48 of the image display panel 40. The chunk determining unit 76 performs the consecutiveness determination on the pixel 48 at a sampling point extracted from among all the pixels 48 of the image display panel 40. The chunk determining unit 76 performs the consecutiveness determination on the pixels 48 at the sampling point in a determination direction Z from the starting pixel 48*s*, sequentially along the determination direction Z. The determination direction Z is the horizontal direction (the X direction) and the vertical direction (the Y direction). The chunk determining unit 76 performs the consecutiveness determination in both the horizontal direction and the vertical direction. The chunk determining unit 76 may perform the consecutiveness determination in either of the horizontal direction and the vertical direction or may perform the consecutiveness determination using a direction oblique from the horizontal direction or the vertical direction as the determination direction Z. The horizontal direction is a direction in which a writing position moves when an image is written on the image display panel 40. In other words, a moving direction of a pixel whose signal is processed at the time of data processing is the horizontal direction. The vertical direction is a direction orthogonal to the horizontal direction as described above. The chunk determining unit 76 analyzes the pixel at the sampling point and thus can reduce an operation process to be smaller than when all the pixels 48 are analyzed without using the sampling point. Preferably, the sampling points are set at predetermined pixel intervals. The sampling points may deviate in either of the horizontal direction and the vertical direction or may overlap. The chunk determining unit 76 may perform the consecutiveness determination on all the pixels 48 without using the sampling point.

Specifically, when the starting pixel 48*s* is selected, the chunk determining unit 76 calculates a consecutiveness determination value for the consecutiveness determination based on the pixel index value $1/\alpha_1$ of the starting pixel 48*s*. In the first embodiment, the consecutiveness determination value includes an upper boundary value Up and a lower boundary value Bo. The upper boundary value Up is a value larger than the pixel index value $1/\alpha_1$ of the starting pixel 48*s*, and a lower boundary value Bo is a value smaller than the pixel index value $1/\alpha_1$ of the starting pixel 48*s*. The chunk determining unit 76 sets a value that is larger than the pixel index value $1/\alpha_1$ of the starting pixel 48*s* by a predetermined value A1 as the upper boundary value Up. The chunk determining unit 76 sets a value that is smaller than the pixel index value $1/\alpha_1$ of the starting pixel 48*s* by a predetermined value A2 as the lower boundary value Bo. The predetermined values A1 and A2 are values that are set in advance and have the same value. The predetermined values A1 and A2 may be different values or may be changed according to a setting performed by an operator, for example.

After the upper boundary value Up and the lower boundary value Bo are calculated, the chunk determining unit 76 performs the consecutiveness determination on the pixel 48 at the sampling point in the determination direction Z from the selected starting pixel 48*s*. A pixel on which the consecutiveness determination is performed is indicated by a determination pixel 48*u*. The chunk determining unit 76 determines the determination pixel 48*u* to be a pixel consecutive to the starting pixel 48*s*, when the pixel index value $1/\alpha_1$ of the determination pixel 48*u* is a value between the lower boundary value Bo and the upper boundary value Up (a value that is equal to or larger than the lower boundary value Bo and equal to or less than the upper boundary value Up). The chunk determining unit 76 determines the determination pixel 48*u* to be a pixel inconsecutive to the starting pixel 48*s*, when the pixel index value $1/\alpha_1$ of the determination pixel 48*u* is a value out of the range of the value between the lower boundary value Bo and the upper boundary value Up. When the determination pixel 48*u* is determined to be consecutive, the chunk determining unit 76 sets the pixel 48 at the next sampling point as the determination pixel 48*u*, and performs the same consecutiveness determination. The chunk determining unit 76 determines the pixels 48 between the starting pixel 48*s* and the pixel 48 determined to be consecutive immediately before the pixel 48 determined to be inconsecutive, as the consecutive pixels.

When the determination pixel 48*u* is determined to be inconsecutive, the chunk determining unit 76 suspends the consecutiveness determination. The chunk determining unit 76 selects the determination pixel 48*u* determined to be inconsecutive as a new starting pixel 48*s*. The chunk determining unit 76 resumes the consecutiveness determination using the new starting pixel 48*s* as the starting point. The pixels 48 determined to be consecutive in one consecutiveness determination are consecutive to each other, but the pixels 48 in different consecutiveness determinations are inconsecutive to each other.

In further detail, an immediately previous pixel 48*t* is a pixel that has undergone the consecutiveness determination immediately before the determination pixel 48*u*. The chunk determining unit 76 determines the starting pixel 48*s* to the determination pixel 48*u* to be consecutive, when the pixel index value $1/\alpha_1$ of the immediately previous pixel 48*t* is the value between the lower boundary value Bo and the upper boundary value Up, and the pixel index value $1/\alpha_1$ of the determination pixel 48*u* is the value between the lower boundary value Bo and the upper boundary value Up. In other words, when the immediately previous pixel 48*t* is not the value between the lower boundary value Bo and the upper boundary value Up, the immediately previous pixel 48*t* is determined to be inconsecutive. Thus even when the determination pixel 48*u* to be determined next is the value between the lower boundary value Bo and the upper boundary value Up, the determination pixel 48*u* is determined to be inconsecutive to the starting pixel 48*s*.

Figure 8:
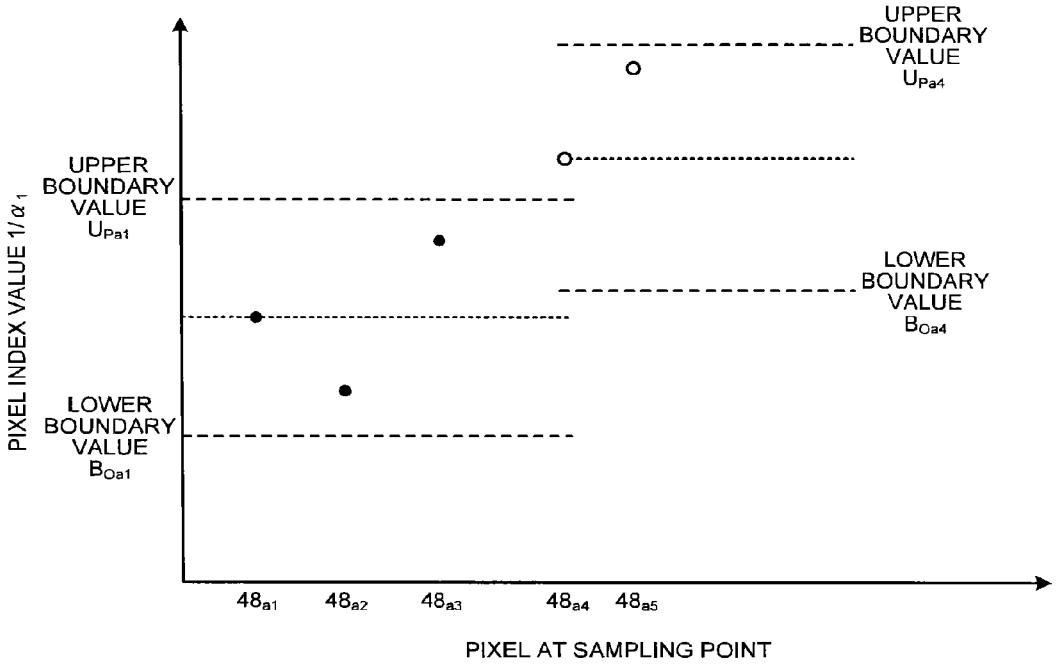
FIG. 8 is an explanatory diagram illustrating an example for describing consecutiveness determination.

FIG. 8 is an explanatory diagram of an example for describing the consecutiveness determination. An example of the above-described consecutiveness determination will be described with reference to FIG. 8. In FIG. 8, a horizontal axis indicates each pixel 48 at the sampling point, and a vertical axis indicates the pixel index value $1/\alpha_1$ of each pixel 48 at the sampling point. In other words, FIG. 8 illustrates the pixel index value $1/\alpha_1$ of each pixel 48 at the sampling point.

When a pixel $\mathbf{48}_{a1}$ is selected as the starting pixel 48*s*, and the consecutiveness determination is performed as illustrated in FIG. 8, the chunk determining unit 76 calculates an upper boundary value $Up_{a1}$ of the pixel $\mathbf{48}_{a1}$ and a lower boundary value $Bo_{a1}$ of the pixel $\mathbf{48}_{a1}$ based on the pixel index value $1/\alpha_1$ of the pixel $\mathbf{48}_{a1}$.

After the upper boundary value $Up_{a1}$ and the lower boundary value $Bo_{a1}$ are calculated, the chunk determining unit 76 sets a pixel $\mathbf{48}_{a2}$ serving as the determination pixel 48*u* at the sampling point next to the pixel $\mathbf{48}_{a1}$ in the determination direction Z. The chunk determining unit 76 determines whether or not the pixel $\mathbf{48}_{a2}$ is consecutive to the pixel $\mathbf{48}_{a1}$. As illustrated in FIG. 8, the pixel index value $1/\alpha_1$ of the pixel $\mathbf{48}_{a2}$ is a value between the upper boundary value $Up_{a1}$ and the lower boundary value $Bo_{a1}$. Thus, the chunk determining unit 76 determines the pixel $\mathbf{48}_{a2}$ to be consecutive to the pixel $\mathbf{48}_{a1}$.

After the pixel $\mathbf{48}_{a2}$ is determined to be consecutive, the chunk determining unit 76 sets a pixel $\mathbf{48}_{a3}$ serving as the pixel at the sampling point next to the pixel $\mathbf{48}_{a2}$ as the determination pixel 48*u*. The chunk determining unit 76 determines whether or not the pixel $\mathbf{48}_{a3}$ is consecutive to the pixel $\mathbf{48}_{a1}$. As illustrated in FIG. 8, the pixel index value $1/\alpha_1$ of the pixel $\mathbf{48}_{a3}$ is a value between the upper boundary value $Up_{a1}$ and the lower boundary value $Bo_{a1}$. Thus, the chunk determining unit 76 determines the pixel $\mathbf{48}_{a3}$ to be consecutive to the pixel $\mathbf{48}_{a1}$.

After the pixel $\mathbf{48}_{a3}$ is determined to be consecutive, the chunk determining unit 76 similarly performs the consecutiveness determination on a pixel $\mathbf{48}_{a4}$ serving as the pixel at the sampling point next to the pixel $\mathbf{48}_{a3}$. As illustrated in FIG. 8, the pixel index value $1/\alpha_1$ of the pixel $\mathbf{48}_{a4}$ is a value out of the range between the upper boundary value $Up_{a1}$ and the lower boundary value $Bo_{a1}$. Thus, the chunk determining unit 76 determines the pixel $\mathbf{48}_{a4}$ to be inconsecutive to the pixel $\mathbf{48}_{a1}$. The chunk determining unit 76 determines the pixel $\mathbf{48}_{a1}$ to the pixel $\mathbf{48}_{a3}$ to be consecutive, and determines a plurality of pixels 48 of the pixel $\mathbf{48}_{a1}$ to the pixel $\mathbf{48}_{a3}$ as a chunk.

Since the pixel $\mathbf{48}_{a4}$ is determined to be inconsecutive to the pixel $\mathbf{48}_{a1}$, the chunk determining unit 76 suspends the consecutiveness determination using the pixel $\mathbf{48}_{a1}$ as the starting pixel 48*s*. Then, the chunk determining unit 76 newly resumes the consecutiveness determination using the pixel $\mathbf{48}_{a4}$ as the starting pixel 48*s*. The chunk determining unit 76 similarly calculates an upper boundary value $Up_{a4}$ and a lower boundary value $Bo_{a4}$ of the pixel $\mathbf{48}_{a4}$. The chunk determining unit 76 performs the consecutiveness determination on a pixel $\mathbf{48}_{a5}$ serving as the pixel at the sampling point next to the pixel $\mathbf{48}_{a4}$. As illustrated in FIG. 8, the pixel index value $1/\alpha_1$ of the pixel $\mathbf{48}_{a5}$ is a value between the upper boundary value $Up_{a4}$ and the lower boundary value $Bo_{a4}$. Thus, the chunk determining unit 76 determines the pixel $\mathbf{48}_{a5}$ to be consecutive to the pixel $\mathbf{48}_{a4}$. The chunk determining unit 76 repeatedly performs the same consecutiveness determination process as described above.

As described above, the chunk determining unit 76 performs the consecutiveness determination, and determines the pixels 48 determined to be consecutive as a chunk. The chunk index value calculating unit 78 acquires information (position information) of the pixels configuring the chunk and information of the pixel index value $1/\alpha_1$ of the pixels 48 included in the chunk from the chunk determining unit 76. The chunk index value calculating unit 78 sets the maximum value among the pixel index values $1/\alpha_1$ of all the pixels 48 included in the chunk as the chunk index value $1/\alpha_2$ of the chunk. The chunk index value $1/\alpha_2$ is a value common to the pixels 48 included in the chunk. Among all the pixels 48 included in the chunk, the starting pixel 48*s* is also included.

Figure 9:
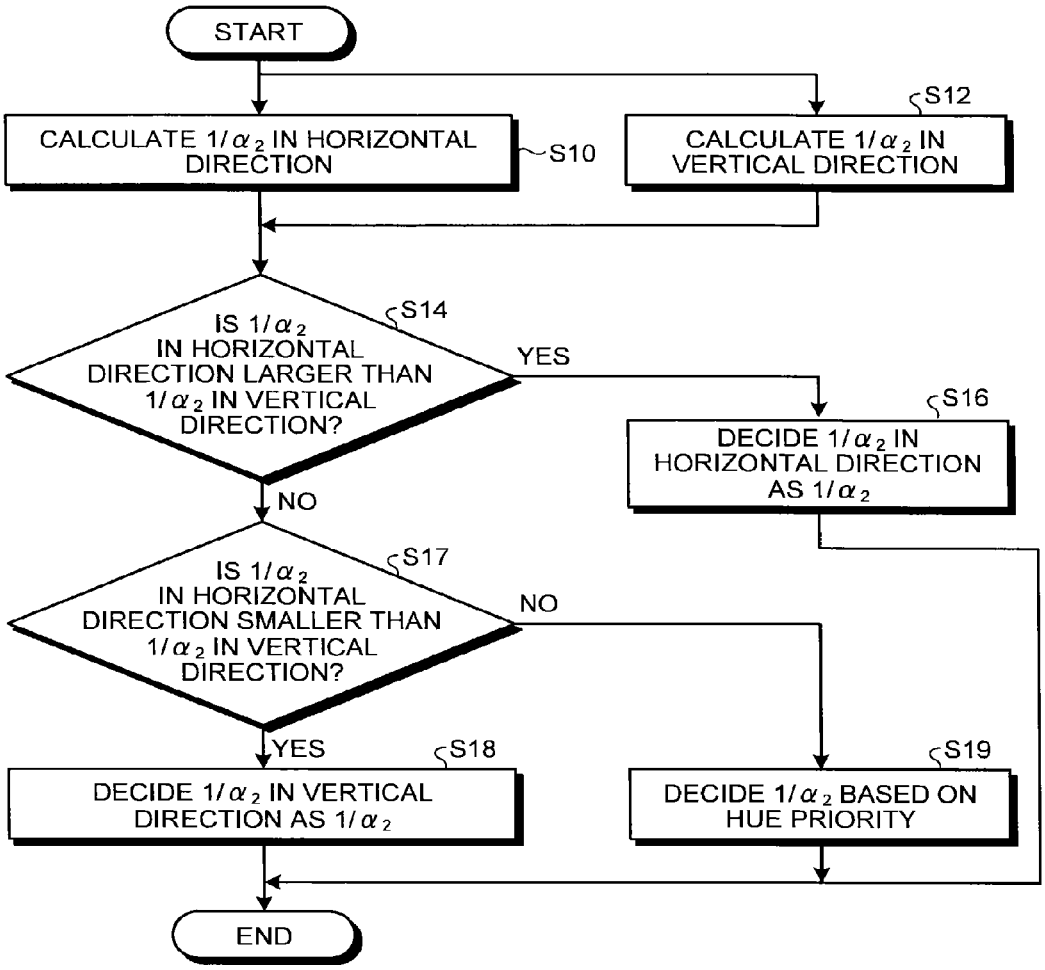
FIG. 9 is a flowchart for describing is a flowchart for describing a chunk index value calculation process.

A process flow of a process of calculating the chunk index value $1/\alpha_2$ will be described with reference to a flowchart. FIG. 9 is a flowchart for describing the chunk index value calculation process. As illustrated in FIG. 9, based on the consecutiveness determination result of the chunk determining unit 76, the chunk index value calculating unit 78 calculates the chunk index value $1/\alpha_2$ in the horizontal direction (step S10) and calculates the chunk index value $1/\alpha_2$ in the vertical direction (step S12). The process of steps S10 and S12 will be described later. The process of step S10 and the process of step S12 may be performed in parallel or sequentially.

When the horizontal direction and the chunk index value $1/\alpha_2$ in the vertical direction are calculated, the chunk index value calculating unit 78 determines whether or not the chunk index value $1/\alpha_2$ in the horizontal direction is larger than the chunk index value $1/\alpha_2$ in the vertical direction (step S14). When the chunk index value $1/\alpha_2$ in the horizontal direction is determined to be larger than the chunk index value $1/\alpha_2$ in the vertical direction (Yes in step S14), the chunk index value calculating unit 78 decides the chunk index value $1/\alpha_2$ in the horizontal direction as the chunk index value $1/\alpha_2$ (step S16), and then ends the current process. When the chunk index value $1/\alpha_2$ in the horizontal direction is not larger than the chunk index value $1/\alpha_2$ in the vertical direction (No in step S14), that is, when the chunk index value $1/\alpha_2$ in the horizontal direction is determined to be equal to or less than the chunk index value $1/\alpha_2$ in the vertical direction, the chunk index value calculating unit 78 determines whether or not the chunk index value $1/\alpha_2$ in the horizontal direction is smaller than the chunk index value $1/\alpha_2$ in the vertical direction (step S17).

When the chunk index value $1/\alpha_2$ in the horizontal direction is determined to be smaller than the chunk index value $1/\alpha_2$ in the vertical direction (Yes in step S17), the chunk index value calculating unit 78 decides the chunk index value $1/\alpha_2$ in the vertical direction as the chunk index value $1/\alpha_2$ (step S18), and then ends the current process. In other words, the chunk index value calculating unit 78 sets a larger one of the chunk index value $1/\alpha_2$ in the horizontal direction and the chunk index value $1/\alpha_2$ in the vertical direction as the chunk index value $1/\alpha_2$. When the chunk index value $1/\alpha_2$ of the chunk in the horizontal direction is determined to be not smaller than the chunk index value $1/\alpha_2$ in the vertical direction (No in step S17), that is, when the chunk index value $1/\alpha_2$ in the horizontal direction is equal to the chunk index value $1/\alpha_2$ in the vertical direction, the chunk index value calculating unit 78 decides the chunk index value $1/\alpha_2$ according to a hue priority (step S19). Specifically, of the chunk index value $1/\alpha_2$ in the horizontal direction and the chunk index value $1/\alpha_2$ in the vertical direction, the chunk index value $1/\alpha_2$ that is higher in the hue priority is decided as the chunk index value $1/\alpha_2$. For example, yellow, yellowish green, cyan, green, magenta, violet, red, and blue is the descending order of high priorities.

Figure 10:
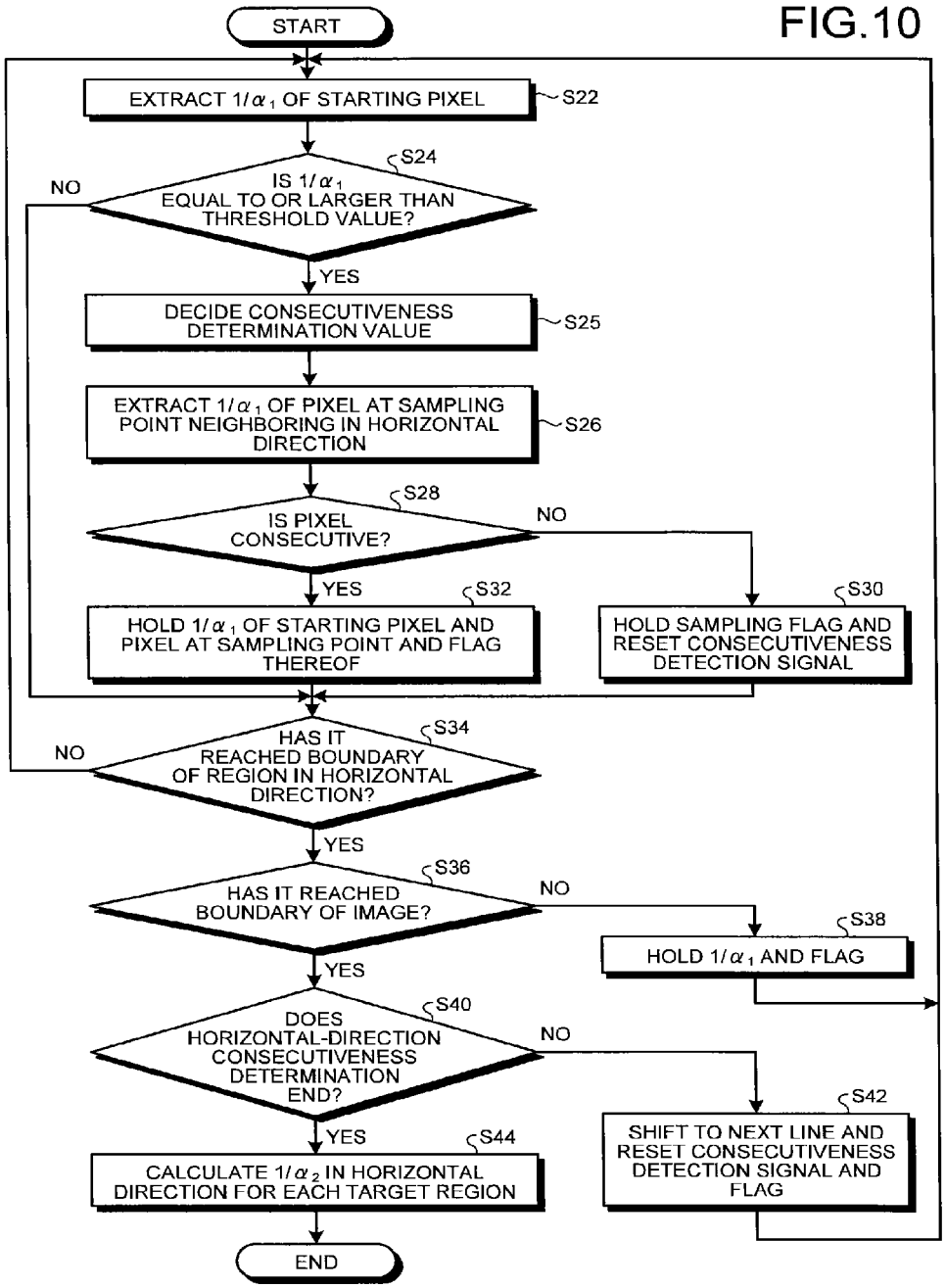
FIG. 10 is a flowchart for describing a horizontal-direction chunk index value calculation process.

Next, a method of calculating (deciding) the chunk index value $1/\alpha_2$ in the horizontal direction will be described. FIG. 10 is a flowchart for describing a horizontal-direction chunk index value calculation process. In the signal processing unit 20, the chunk determining unit 76 performs the consecutiveness determination using the horizontal direction as the determination direction Z, and calculates the chunk index value $1/\alpha_2$ in the horizontal direction based on the determination result of the consecutiveness determination.

As illustrated in FIG. 10, in the signal processing unit 20, the chunk determining unit 76 extracts the pixel index value $1/\alpha_1$ of the starting pixel 48*s* (step S22), and determines whether or not the pixel index value $1/\alpha_1$ of the starting pixel 48*s* is equal to or larger than a threshold value (step S24). Here, the threshold value is a predetermined value and used as a reference for determining the pixel index value $1/\alpha_1$ to be in a range in which chunk detection need not be considered (an adjustment of the present embodiment is unnecessary). 8'h20 is used as an example of the threshold value, but the threshold value is not limited thereto. When the pixel index value $1/\alpha_1$ of the starting pixel 48*s* is determined to be neither equal to nor larger than the threshold value (No in step S24), that is, when the pixel index value $1/\alpha_1$ is determined to be smaller than the threshold value, the chunk determining unit 76 proceeds to step S34.

When the pixel index value $1/\alpha_1$ of the starting pixel 48*s* is determined to be equal to or larger than the threshold value (Yes in step S24), the chunk determining unit 76 decides a consecutiveness determination value for the consecutiveness determination (step S25). In the first embodiment, the consecutiveness determination value is the upper boundary value Up and the lower boundary value Bo calculated based on the pixel index value $1/\alpha_1$ of the starting pixel 48*s*.

After the consecutiveness determination value is decided, the chunk determining unit 76 extracts the pixel index value $1/\alpha_1$ of the sampling point adjacent to the starting pixel 48*s* in the horizontal direction (step S26), and determines whether or not the pixel at the sampling point is consecutive to the starting pixel 48*s* (step S28). The chunk determining unit 76 determines that the pixel at the sampling point is consecutive to the starting pixel 48*s*, when the pixel index value $1/\alpha_1$ of the pixel at the sampling point is a value within the range of the consecutiveness determination value (the value between the upper boundary value Up and the lower boundary value Bo). For example, the chunk determining unit 76 may determine that the pixels of the sampling points are consecutive, when the pixels of the sampling points corresponding to a set number of 2 or more are consecutive to the starting pixel 48*s*. In other words, in this case, when the starting pixel 48*s* is consecutive to a pixel 48*k* serving as the pixel 48 at the next sampling point, and the starting pixel 48*s* is inconsecutive to a pixel 48*l* at the next sampling point of the pixel 48*k*, the chunk determining unit 76 determines that the starting pixel 48*s* is inconsecutive to the pixel 48*k*.

When the pixel is determined to be inconsecutive (No in step S28), the chunk determining unit 76 holds a sampling flag, resets a consecutiveness detection signal (step S30), and proceeds to step S34. The consecutiveness detection signal is a signal indicating ON while the sampling point is consecutive. When the pixel is determined to be consecutive (Yes in step S28), the chunk determining unit 76 holds the pixel index values $1/\alpha_1$ of the starting pixel 48*s* and the pixel 48 at the sampling point and the flags thereof (step S32), and then proceeds to step S34.

When determination of the sampling point is performed, the chunk determining unit 76 determines whether or not it has reached the boundary of the region in the horizontal direction (step S34). When it is determined to have not reached the boundary of the region in the horizontal direction (No in step S34), the chunk determining unit 76 returns to step S22, and the same process as described above on the next sampling point. The chunk determining unit 76 repeats the process until it reaches the boundary of the region in the horizontal direction as described above. When it is determined to have reached the boundary of the region in the horizontal direction (Yes in step S34), the chunk determining unit 76 determines whether or not it has reached the boundary of the image, that is, the end of the pixel of the image display panel (step S36).

When it is determined to have not reached the boundary of the image (No in step S36), the chunk determining unit 76 holds the pixel index value $1/\alpha_1$ and the flag (step S38), and then returns to step S22. When it is determined to have reached the boundary of the image (Yes in step S36), the chunk determining unit 76 determines whether or not the horizontal-direction consecutiveness determination process ends, that is, determines whether or not the consecutiveness determination has been performed on all the sampling points of the image (step S40).

When the horizontal-direction consecutiveness determination is determined not to end (No in step S40), the chunk determining unit 76 shifts to a next line, resets the consecutiveness detection signal and the flag (step S42), and returns to step S22. When the horizontal-direction consecutiveness determination is determined to end (Yes in step S40), the chunk determining unit 76 decides the chunk index value $1/\alpha_2$ in the horizontal direction for each target region (step S44), and then ends the current process. The chunk determining unit 76 decides the maximum value among the pixel index values $1/\alpha_1$ of the pixels determined to be consecutive as the chunk index value $1/\alpha_2$ in the horizontal direction.

Figure 11:
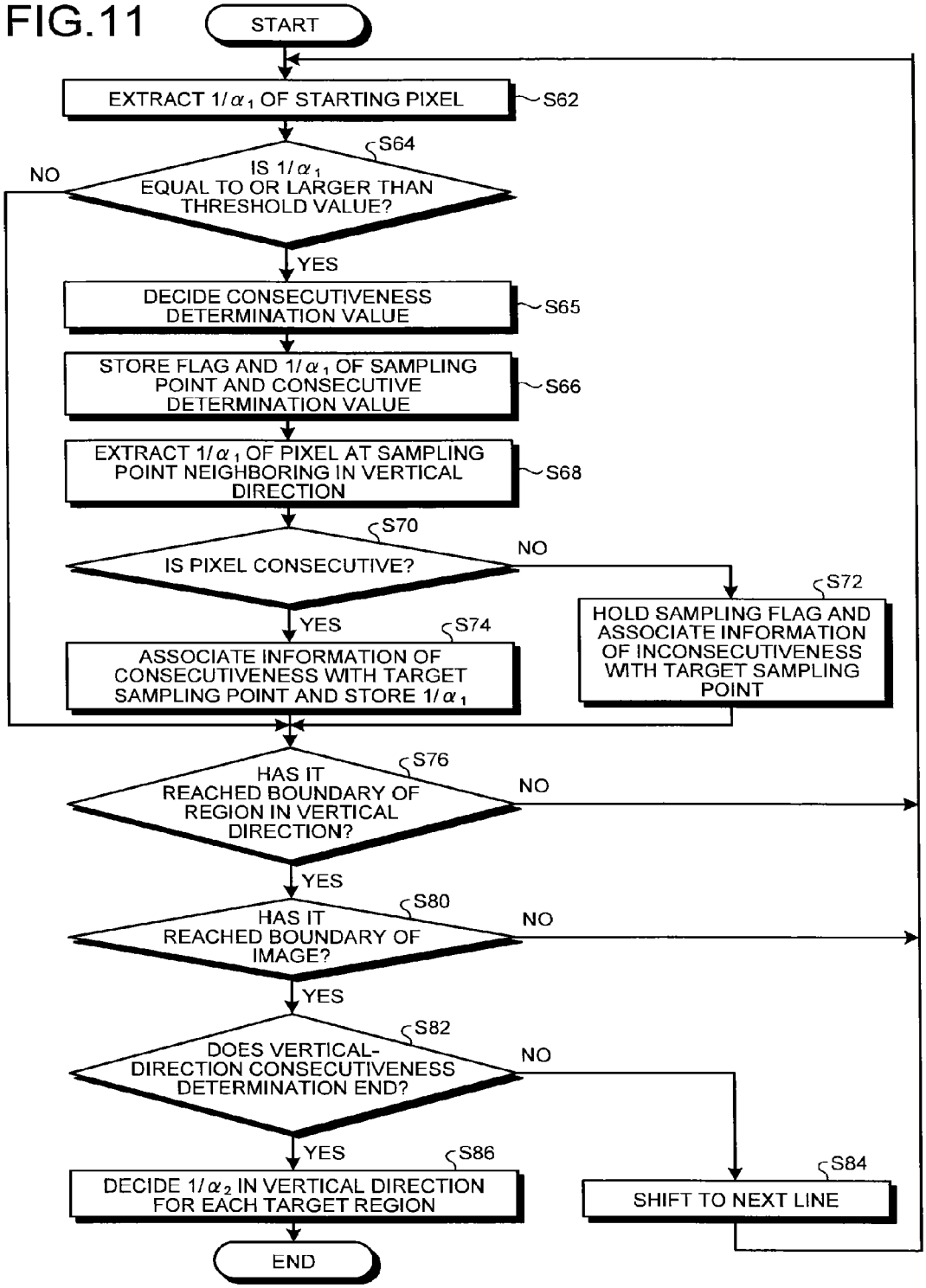
FIG. 11 is a flowchart for describing a vertical-direction chunk index value calculation process.

Next, a method of calculating (deciding) the chunk index value $1/\alpha_2$ in the vertical direction will be described. FIG. 11 is a flowchart for describing a vertical-direction the chunk index value calculation process. In the signal processing unit 20, the chunk determining unit 76 performs the consecutiveness determination using the vertical direction as the determination direction Z, calculates the chunk index value $1/\alpha_2$ in the vertical direction based on the determination result of the consecutiveness determination.

The chunk determining unit 76 extracts the pixel index value $1/\alpha_1$ of the starting pixel 48*s* (step S62), and determines whether or not the pixel index value $1/\alpha_1$ of the starting pixel 48*s* is equal to or larger than a threshold value (step S64). When the pixel index value $1/\alpha_1$ of the starting pixel 48*s* is determined to be neither equal to nor larger than the threshold value (No in step S64), that is, when the pixel index value $1/\alpha_1$ is determined to be smaller than the threshold value, the chunk determining unit 76 proceeds to step S76.

When the pixel index value $1/\alpha_1$ of the starting pixel 48*s* is determined to be equal to or larger than the threshold value (Yes in step S64), the chunk determining unit 76 decides the consecutiveness determination value for the consecutiveness determination (step S65). In the first embodiment, the consecutiveness determination value is the upper boundary value Up and the lower boundary value Bo calculated based on the pixel index value $1/\alpha_1$ of the starting pixel 48*s*.

After the consecutiveness determination value is decided, the chunk determining unit 76 stores the flag and the pixel index value $1/\alpha_1$ of the starting pixel 48*s* and the consecutiveness determination value in a FIFO, RAM, or the like (step S66), extracts the pixel index value $1/\alpha_1$ of the sampling point neighboring in the vertical direction (step S68), and determines whether or not the pixel at the sampling point is consecutive (step S70). The consecutiveness determines method is the same as that in the horizontal direction.

When the pixel at the sampling point is determined to be inconsecutive (No in step S70), the chunk determining unit 76 holds the sampling flag, and associates information of inconsecutiveness with the target sampling point (step S72), and proceeds to step S76. When the pixel at the sampling point is determined to be consecutive (Yes in step S70), the chunk determining unit 76 associates information of consecutiveness with the target sampling point, stores the pixel index value $1/\alpha_1$ of the sampling point (step S74), and proceeds to step S76.

When determination of the sampling point is performed, the chunk determining unit 76 determines whether or not it has reached the boundary of the region in the vertical direction (step S76). When it is determined to have not reached the boundary of the region in the vertical direction (No in step S76), the chunk determining unit 76 returns to step S62, and performs the same process as described above on the next sampling point. When it is determined to have reached the boundary of the region in the vertical direction (Yes in step S76), the chunk determining unit 76 determines whether or not it has reached the boundary of the image, that is, the end of the image display panel 40 (step S80).

When it is determined to have not reached the boundary of the image (No in step S80), the chunk determining unit 76 returns to step S62. When it is determined to have reached the boundary of the image (Yes in step S80), the chunk determining unit 76 determines whether or not the vertical-direction consecutiveness determination ends, that is, whether or not the consecutiveness determination has performed on all the sampling points of the image (step S82).

When the vertical-direction consecutiveness determination is determined not to end (No in step S82), the chunk determining unit 76 shifts to a next line, (step S84), and then returns to step S62. When the vertical-direction consecutiveness determination is determined to end (Yes in step S82), the chunk determining unit 76 decides the chunk index value $1/\alpha_2$ in the vertical direction for each target region (step S86), and then ends the current process. The chunk determining unit 76 decides the maximum value among the pixel index values $1/\alpha_1$ of the pixels determined to be consecutive as the chunk index value $1/\alpha_2$ in the vertical direction.

Region Index Value Calculation Process

Next, a process of calculating the region index value $1/\alpha_3$ through the region index value calculating unit 80 will be described.

The region index value calculating unit 80 acquires the information of the pixel index value $1/\alpha_1$ of the pixel 48 in the target region from the pixel index value calculating unit 74, and acquires the hue information of the pixel 48 in the target region from the hue determining unit 73. The region index value calculating unit 80 calculates the region index value $1/\alpha_3$ serving as the index value of the entire target region based on the information of the pixel index value $1/\alpha_1$ and the hue information using a predetermined algorithm. Here, an example of a predetermined algorithm is described, but not limited to. In the predetermined algorithm, a distribution of the pixel index values $1/\alpha_1$ of the pixels 48 in the target region is calculated. And pixel index values are extracted so that the number of pixels which have pixel index values equal or larger than the extracted pixel index values are higher than predetermined number of pixels. And a largest pixel index value $1/\alpha_1$ among the extracted pixel index values is decided as the region index value $1/\alpha_3$. The region index value $1/\alpha_3$ is a value common to all the pixels 48 in the target region. When there are a plurality of target regions, the region index value calculating unit 80 calculates the region index value $1/\alpha_3$ for all the target regions.

Region Light Irradiation Value Calculation Process

Next, a process of calculating the region index value $1/\alpha_3$ through the light irradiation amount deciding unit 82 will be described.

The light irradiation amount deciding unit 82 acquires the information of the chunk index value $1/\alpha_2$ from the chunk index value calculating unit 78, and acquires the information of the region index value $1/\alpha_3$ from the region index value calculating unit 80. The light irradiation amount deciding unit 82 compares the value of the chunk index value $1/\alpha_2$ with the value of the region index value $1/\alpha_3$ in the target region. The light irradiation amount deciding unit 82 decides one of the value of the chunk index value $1/\alpha_2$ in the target region and the value of the region index value $1/\alpha_3$ in the target region, by which the irradiation amount of light of the light source unit 60 is increased, as the region light irradiation value $1/\alpha$. The region light irradiation value $1/\alpha$ is a value common to all the pixels 48 in the target region. When there are a plurality of target regions, the light irradiation amount deciding unit 82 calculates the region light irradiation value $1/\alpha$ for all the target regions.

Figure 12:
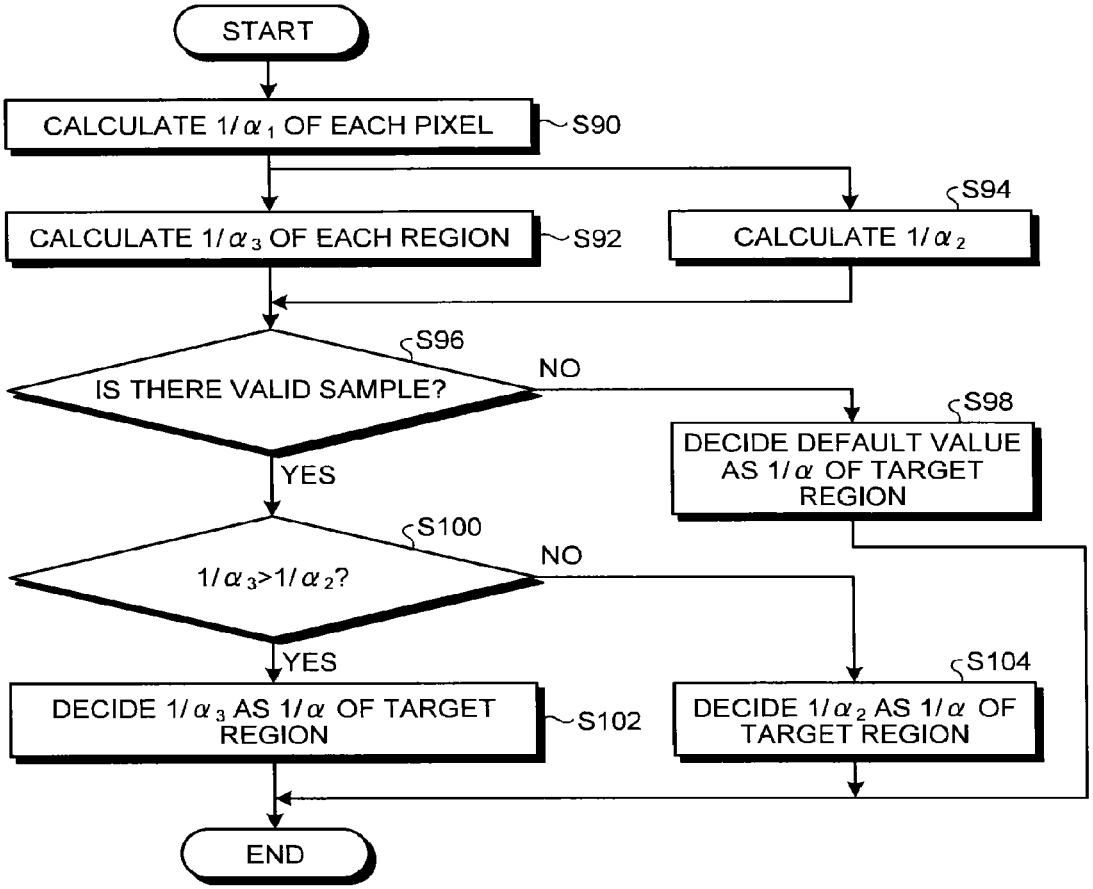
FIG. 12 is a flowchart illustrating a region light irradiation value calculation process.

The process flow of calculating the region light irradiation value $1/\alpha$ described above will be described below with reference to a flowchart. FIG. 12 is a flowchart illustrating the region light irradiation value calculation process. In the signal processing unit 20, the pixel index value calculating unit 74 calculates the pixel index values $1/\alpha_1$ of the respective pixels (step S90). The region index value calculating unit 80 decides the region index value $1/\alpha_3$ for each target region based on the calculate pixel index values $1/\alpha_1$ of the respective pixels (step S92). The chunk index value calculating unit 78 calculates the chunk index value $1/\alpha_2$ (step S94) based on the calculate pixel index values $1/\alpha_1$ of the respective pixels. Here, the process of step S92 and the process of step S94 may be performed in parallel or sequentially.

When the chunk index value $1/\alpha_2$ and the region index value $1/\alpha_3$ are decided, the signal processing unit 20 determines whether or not there is a valid sample (step S96). Specifically, it is determined whether or not the number of samples, that is, the number of samplings that can be determined to be valid as a result of analysis is larger than 0 (zero). In the signal processing unit 20, when it is determined that there is no valid sample (No in step S96), that is, when the number of valid samplings is determined to be 0 (zero), the light irradiation amount deciding unit 82 decides a predetermined default value as the region light irradiation value $1/\alpha$ (step S98), and then ends the current process. Here, for example, 8'h20 may be used as the default value. The valid sample is a group of pixels determined to be consecutive among the pixels at the sampling points, that is, a chunk. When there is no valid sample, it indicates that there is no pixel determined to be consecutive, that is, that no chunk has been detected.

When it is determined that there is a valid sample (Yes in step S96), that is, that the number of valid samplings is 1 or more, the signal processing unit 20 determines whether or not the region index value $1/\alpha_3$ is larger than the chunk index value $1/\alpha_2$ (step S100). In the signal processing unit 20, when the region index value $1/\alpha_3$ is determined to be larger than the chunk index value $1/\alpha_2$ (Yes in step S100), the light irradiation amount deciding unit 82 decides the region index value $1/\alpha_3$ as the region light irradiation value $1/\alpha$ (step S102), and then ends the current process. In the signal processing unit 20, when the region index value $1/\alpha_3$ is determined to be the chunk index value $1/\alpha_2$ or less (No step S100), the light irradiation amount deciding unit 82 decides the chunk index value $1/\alpha_2$ as the region light irradiation value $1/\alpha$ (step S104), and then ends the current process. That is, the signal processing unit 20 sets the larger value as the region light irradiation value $1/\alpha$.

Region Lighting Amount Decision Process

Next, a process of deciding a region lighting amount LA will be described. The LD storage unit 83 stores the luminance distribution information LD of the light source 62. As illustrated in FIGS. 3 and 4, a plurality of light sources 62 differ in the luminance distribution (the intensity distribution of light). Thus a luminance value of the entire surface of the light source unit 60, which is detected when each of the light sources 62 is turned on with a predetermined lighting amount, is stored as the luminance distribution information LD. The luminance distribution information will be described with reference to FIGS. 13 and 14.

Figure 13:
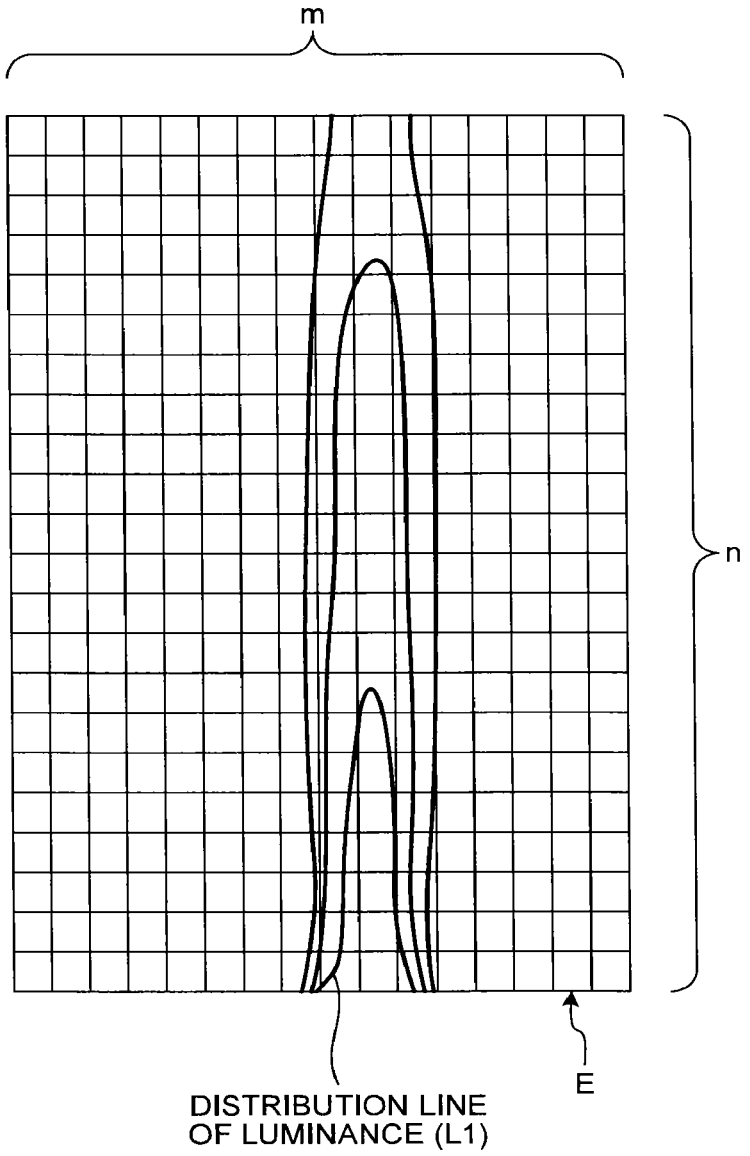
FIG. 13 is a schematic diagram for describing luminance distribution information.

FIG. 13 is a schematic diagram for describing the luminance distribution information. As illustrated in FIG. 13, the luminance distribution information LD is information obtained by dividing the image display surface (or the emission surface 102 of the light source unit 60) of the image display panel 40 into a plurality of regions 104, that is, m×n regions (m is an arbitrary integer satisfying $1 \le m \le P_0$, and n is an arbitrary integer satisfying $1 \le n \le Q_0$). And the luminance distribution information LD is information obtained by storing the luminance value (the intensity value of light) of the light source unit 60 detected for each region 104. The number of regions 104 is arbitrarily set to the extent that the number of pixels is a maximum number. When the region 104 corresponds to one pixel, the luminance value of the pixel unit is stored in the luminance distribution information LD. When the region 104 corresponds to a plurality of pixels, a pixel at a predetermined position in the region 104 is set as a representative pixel, and the luminance value of the light source unit 60 in the representative pixel is stored. In the example of FIG. 13, a luminance value L1 is set to the luminance value of the representative pixel of the region 104 inside a distribution line of luminance (L1) indicating the luminance value L1. The LD storage unit 83 stores the luminance distribution information LD in which the luminance values of the m×n regions 104 are set in a table form for each light source 62. In the following description, the luminance distribution information LD of the table form is referred to as a "light source look-up table LUT (LUT)." Since the light source look-up table LUT is information unique to the display device 10, the light source look-up table LUT is generated in advance and stored in the LD storage unit 83.

Figure 14:
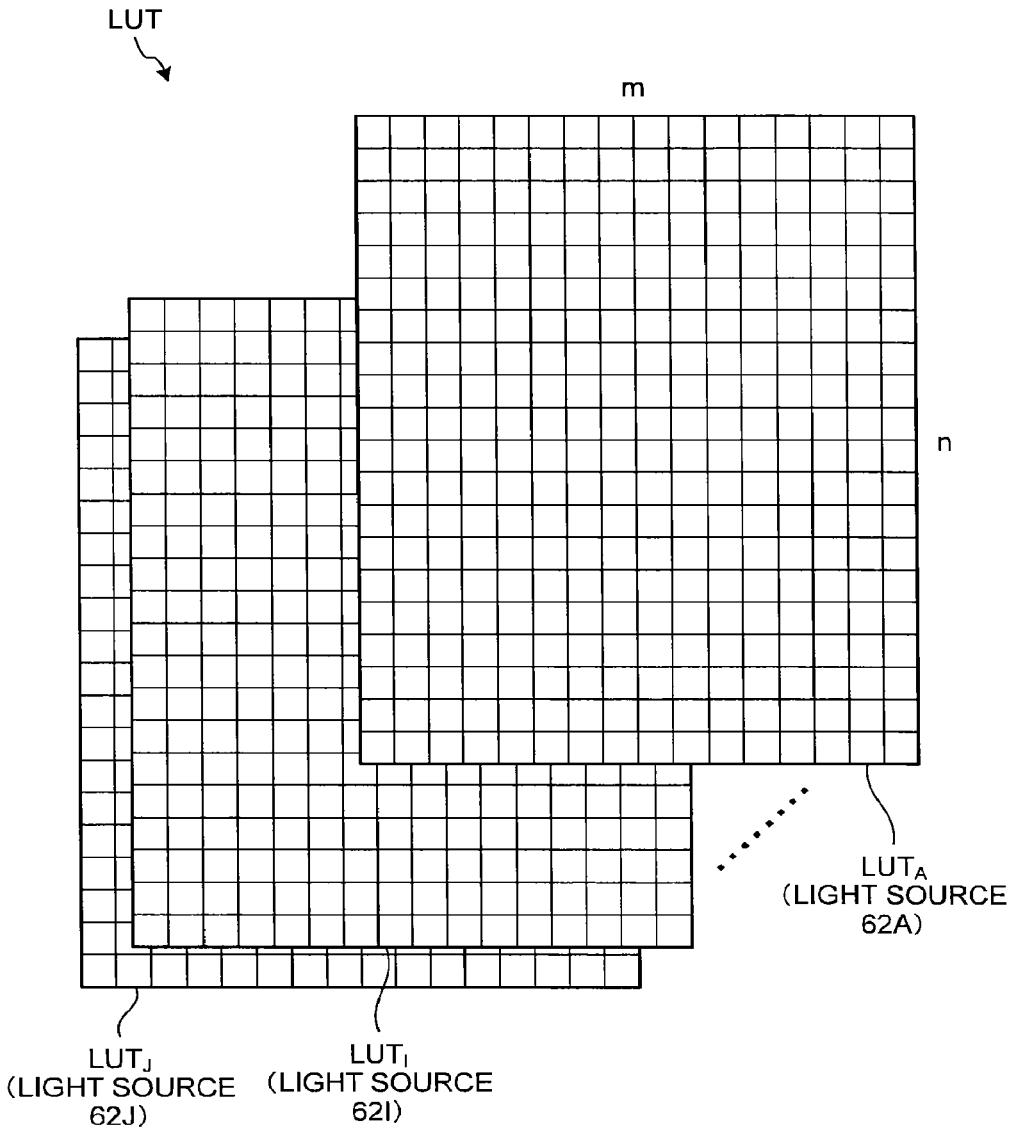
FIG. 14 is a diagram illustrating a light source look-up table.

FIG. 14 is a diagram illustrating the light source look-up table. The light source look-up table LUT is prepared for each of the light sources 62A to 62J. A light source look-up table $LUT_A$ is one in which the luminance value when only a light source 62A is turned on is recorded in a table form by the m×n regions. Similarly, the same light source look-up table LUT is set for a light sources 62B to 62J. In FIG. 14, the light source look-up table $LUT_I$ for the light source 621 and the light source look-up table $LUT_J$ for the light source 62J are illustrated. Using the luminance value of the representative pixel representing a predetermined region 104, it is possible to reduce the size of the light source look-up table LUT and reduce a storage capacity of the LD storage unit 83. When the luminance value of each pixel is unnecessary, it can be calculated by performing an interpolation operation. The light source look-up table LUT is information when one light source 62 is turned on, but, for example, a light source look-up table when a set of the light sources 62A and 62B or a set of the light sources 62C and 62D is simultaneously turned on may be generated and stored. Thus, it is possible to save a work of generating the light source look-up table LUT and reduce the storage capacity of the LD storage unit 83.

The light source look-up table LUT may be set in a state in which the luminance value is corrected to correspond to luminance unevenness correction. Using the light source look-up table LUT, the luminance unevenness correction can be performed at the same time as decision of a lighting pattern.

The light irradiation amount deciding unit 82 decides the region lighting amount $1/\alpha'$ serving as the lighting amount (the lighting pattern) of each light source 62 based on the region light irradiation value $1/\alpha$ and the light source look-up table LUT stored in the LD storage unit 83. The region lighting amount $1/\alpha'$ may be obtained by an operation. The region lighting amount $1/\alpha'$ may be decided such that the tentative region lighting amount is set, and luminance distribution information at the time of driving with the tentative region lighting amount is calculated using the light source look-up table LUT, compared with the region light irradiation value $1/\alpha$, and corrected. The light irradiation amount deciding unit 82 generates the light source control signal SBL based on the region lighting amount $1/\alpha'$, and outputs the light source control signal SBL to the light source unit 60.

The light irradiation amount deciding unit 82 calculates the pixel light irradiation amount $1/\alpha_0$ for each pixel, using the region lighting amount $1/\alpha'$ and the light source look-up table LUT stored in the LD storage unit 83. The pixel light irradiation amount $1/\alpha_0$ is the luminance value (the irradiation amount of light) of the light source unit 60 when each light source 62 is turned on with the region lighting amount $1/\alpha'$. First, the luminance distribution information LD of the respective light sources at the time of driving when the light source 62 is turned on with the region lighting amount $1/\alpha'$ is calculated using the light source look-up table LUT. When information of the pixel unit is not obtained from the light source look-up table LUT, the interpolation operation is performed, and the luminance distribution information LD of the respective light sources at the time of driving is calculated. Then, the luminance distribution information LD of the respective light sources at the time of driving is combined to obtain the luminance distribution information LD of the light source 62 at the time of driving. The pixel light irradiation amount $1/\alpha_0$ is set to the calculated luminance distribution information LD of the sidelight light source 62 at the time of driving in units of pixels.

Output Signal Generation Process

Next, an output signal generation process will be described. First, the signal processing unit 20 calculates the expansion coefficient $\alpha_0$ based on the value of the pixel light irradiation amount $1/\alpha_0$ through the expansion coefficient calculating unit 84. The expansion coefficient $\alpha_0$ is a reciprocal of the pixel light irradiation amount $1/\alpha_0$. The expansion coefficient $\alpha_0$ is a value set for each pixel.

The output signal generating unit 86 of the signal processing unit 20 generates an output signal (a signal value $X_{1-(p,q)}$) of the first sub-pixel for determining a display gradation of the first sub-pixel 49R. The output signal generating unit 86 of the signal processing unit 20 generates an output signal (a signal value $X_{2-(p,q)}$) of the second sub-pixel for determining a display gradation of the second sub-pixel 49G. The output signal generating unit 86 of the signal processing unit 20 generates an output signal (a signal value $X_{3-(p,q)}$) of the third sub-pixel for determining a display gradation of the third sub-pixel 49B. The output signal generating unit 86 of the signal processing unit 20 generates an output signal (signal value $X_{4-(p,q)}$) of the fourth sub-pixel for determining a display gradation of the fourth sub-pixel 49W. The output signal generating unit 86 of the signal processing unit 20 outputs the output signals to the image display panel driving unit 30. The output signal generation process performed by the signal processing unit 20 will specifically be described below.

After the expansion coefficient $\alpha_0$ is calculated, the output signal generating unit 86 of the signal processing unit 20 calculates an output signal value $X_{4-(p,q)}$ of the fourth sub-pixel, based on at least the input signal (the signal value $x_{1-(p,q)}$ of the first sub-pixel, the input signal (the signal value $x_{2-(p,q)}$) of the second sub-pixel, and the input signal (the signal value $x_{3-(p,q)}$) of the third sub-pixel. More specifically, the output signal generating unit 86 of the signal processing unit 20 calculates the output signal value $X_{4-(p,q)}$ of the fourth sub-pixel based on the product of $Min_{(p,q)}$ and the expansion coefficient $\alpha_0$. Specifically, the signal processing unit 20 may obtain the signal value $X_{4-(p,q)}$ based on the following Equation (4). In Equation (4), the product of $Min_{(p,q)}$ and the expansion coefficient $\alpha_0$ is divided by $\chi$, but the present invention is not limited thereto.

$$X_{4-(p,q)}=Min_{(p,q)}\cdot\alpha_0/\chi \quad (4)$$

$\chi$ is a constant depending on the display device 10. No color filter is arranged for the fourth sub-pixel 49W that displays white. The fourth sub-pixel 49W that displays the fourth color is higher in brightness than the first sub-pixel 49R that displays the first color, the second sub-pixel 49G that displays the second color, and the third sub-pixel 49B that displays the third color when they are irradiated with light with the same light source lighting amount. When a signal having a value corresponding to the maximum signal value of the output signal of the first sub-pixel 49R is input to the first sub-pixel 49R, a signal having a value corresponding to the maximum signal value of the output signal of the second sub-pixel 49G is input to the second sub-pixel 49G, and a signal having a value corresponding to the maximum signal value of the output signal of the third sub-pixel 49B is input to the third sub-pixel 49B, luminance of an aggregate of the first sub-pixel 49R, the second sub-pixel 49G, and the third sub-pixel 49B included in the pixel 48 or a group of pixels 48 is assumed to be $BN_{1-3}$. When a signal having a value corresponding to the maximum signal value of the output signal of the fourth sub-pixel 49W is input to the fourth sub-pixel 49W included in the pixel 48 or a group of pixels 48, the luminance of the fourth sub-pixel 49W is assumed to be $BN_4$. That is, white of the maximum luminance is displayed by the aggregate of the first sub-pixel 49R, the second sub-pixel 49G, and the third sub-pixel 49B, and the luminance of the white is indicated by $BN_{1-3}$. In this case, when $\chi$ is a constant depending on the display device 10, the constant $\chi$ is indicated by $\chi=BN_4/BN_{1-3}$.

Specifically, the luminance $BN_4$ when the input signal having the display gradation value of 255 is assumed to be input to the fourth sub-pixel 49W is, for example, 1.5 times the luminance $BN_{1-3}$ of white when the input signals having the display gradation values such as the signal value $x_{1-(p,q)}=255$, the signal value $x_{2-(p,q)}=255$, and the signal value $x_{3-(p,q)}=255$ are input to the aggregate of the first sub-pixel 49R, the second sub-pixel 49G, and the third sub-pixel 49B. That is, in the first embodiment, $\chi=1.5$.

Then, the output signal generating unit 86 of the signal processing unit 20 calculates the output signal (the signal value $X_{1-(p,q)}$) of the first sub-pixel based on at least the input signal of the first sub-pixel (the signal value $x_{1-(p,q)}$) and the expansion coefficient $\alpha_0$. The output signal generating unit 86 of the signal processing unit 20 calculates the output signal (the signal value $X_{2-(p,q)}$) of the second sub-pixel based on at least the input signal (the signal value $x_{2-(p,q)}$) of the second sub-pixel and the expansion coefficient $\alpha_0$. The output signal generating unit 86 of the signal processing unit 20 calculates the output signal (the signal value $X_{3-(p,q)}$ of the third sub-pixel based on at least the input signal (the signal value $x_{3-(p,q)}$ of the third sub-pixel and the expansion coefficient $\alpha_0$.

Specifically, the signal processing unit 20 calculates the output signal of the first sub-pixel based on the input signal of the first sub-pixel, the expansion coefficient $\alpha_0$, and the output signal of the fourth sub-pixel. The signal processing unit 20 calculates the output signal of the second sub-pixel based on the input signal of the second sub-pixel, the expansion coefficient $\alpha_0$, and the output signal of the fourth sub-pixel. The signal processing unit 20 calculates the output signal of the third sub-pixel based on the input signal of the third sub-pixel, the expansion coefficient $\alpha_0$, and the output signal of the fourth sub-pixel.

In other words, the signal processing unit 20 calculates the output signal value $X_{1-(p,q)}$ of the first sub-pixel, the output signal value $X_{2-(p,q)}$ of the second sub-pixel, and the output signal value $X_{3-(p,q)}$ of the third sub-pixel which are supplied to the (p,q)-th pixel 48 (or the set of the first sub-pixel 49R, the second sub-pixel 49G, and the third sub-pixel 49B) using Equations (5) to (7), respectively, when $\chi$ is a constant depending on the display device 10.

$$X_{1-(p,q)}=\alpha_0 \cdot x_{1-(p,q)}-\chi \cdot X_{4-(p,q)} \tag{5}$$

$$X_{2-(p,q)}=\alpha_0 \cdot x_{2-(p,q)}-\chi \cdot X_{4-(p,q)} \tag{6}$$

$$X_{3-(p,q)}=\alpha_0 \cdot x_{3-(p,q)}-\chi \cdot X_{4-(p,q)} \tag{7}$$

As described above, the signal processing unit 20 generates the output signals of the sub-pixels 49. Next, a method (expansion process) of obtaining the signal values $X_{1-(p,q)}$, $X_{2-(p,q)}$, $X_{3-(p,q)}$, and $X_{4-(p,q)}$ that are the output signals of the (p,q)-th pixel 48 will be described. The following processes are performed to keep a ratio of the luminance of the first primary color displayed by (the first sub-pixel 49R+the fourth sub-pixel 49W), the luminance of the second primary color displayed by (the second sub-pixel 49G+the fourth sub-pixel 49W), and the luminance of the third primary color displayed by (the third sub-pixel 49B+the fourth sub-pixel 49W). The processes are performed to keep (maintain) a color tone as well. In addition, the processes are performed to keep (maintain) gradation-luminance characteristics (gamma characteristics, $\gamma$ characteristics). When all of the input signal values are 0 or small values in any one of the pixels 48 or a group of the pixels 48, the expansion coefficient $\alpha_0$ may be obtained without including such a pixel 48 or a group of pixels 48.

First Process

First, in the signal processing unit 20, the expansion coefficient calculating unit 84 calculates the expansion coefficient $\alpha_0$ for each pixel based on the pixel light irradiation amount $1/\alpha_0$ of the target region.

Second Process

Then, the signal processing unit 20 calculates the signal value $X_{4-(p,q)}$ in the (p,q)-th pixel 48 based on at least the signal value $x_{1-(p,q)}$, the signal value $x_{2-(p,q)}$, and the signal value $x_{3-(p,q)}$. In the first embodiment, the signal processing unit 20 decides the signal value $X_{4-(p,q)}$ based on $Min_{(p,q)}$, the expansion coefficient $\alpha_0$, and the constant $\chi$. More specifically, the signal processing unit 20 calculates the signal value $X_{4-(p,q)}$ based on Equation (4) as described above. The signal processing unit 20 calculates the signal value $X_{4-(p,q)}$ for all the pixels 48 in the target region.

Third Process

Then, the signal processing unit 20 obtains the signal value $X_{1-(p,q)}$ in the (p,q)-th pixel 48 based on the signal value $x_{1-(p,q)}$, the expansion coefficient $\alpha_0$, and the signal value $X_{4-(p,q)}$. The signal processing unit 20 obtains the signal value $X_{2-(p,q)}$ in the (p,q)-th pixel 48 based on the signal value $x_{2-(p,q)}$, the expansion coefficient $\alpha_0$, and the signal value $X_{4-(p,q)}$. The signal processing unit 20 obtains the signal value $X_{3-(p,q)}$ in the (p,q)-th pixel 48 based on the signal value $x_{3-(p,q)}$, the expansion coefficient $\alpha_0$, and the signal value $X_{4-(p,q)}$. Specifically, the signal processing unit 20 obtains the signal value $X_{1-(p,q)}$, the signal value $X_{2-(p,q)}$, and the signal value $X_{3-(p,q)}$ in the (p,q)-th pixel 48 based on Equations (5) to (7) described above.

The output signal generating unit 86 of the signal processing unit 20 generates the output signals for each target region through the above process, and outputs the generated output signals to the image display panel driving unit 30.

As described above, in the display device 10, the signal processing unit 20 includes the pixel index value calculating unit 74 that calculates the pixel index value $1/\alpha_1$ based on the input signal for each pixel. The signal processing unit 20 includes the chunk determining unit 76 that performs the consecutiveness determination which determines whether or not the pixel, having the pixel index value $1/\alpha_1$ between the upper boundary value Up and the lower boundary value Bo is consecutive to the starting pixel 48*s*, and determines the regions of the pixels determined to be consecutive as a chunk. The signal processing unit 20 includes the chunk index value calculating unit 78 that calculates the chunk index value $1/\alpha_2$ based on the pixel index values $1/\alpha_1$ of the pixels 48 included in the chunk. The signal processing unit 20 includes the region index value calculating unit 80 that calculates the region index value $1/\alpha_3$ based on the pixel index values $1/\alpha_1$ of all the pixels 48 in the target region. The signal processing unit 20 includes the light irradiation amount deciding unit 82 compares the chunk index value $1/\alpha_2$ with the region index value $1/\alpha_3$, and decides the irradiation amount of light (the region light irradiation value $1/\alpha$) of the light source unit in the target region based on the value by which the irradiation amount of light is increased.

Figure 15:
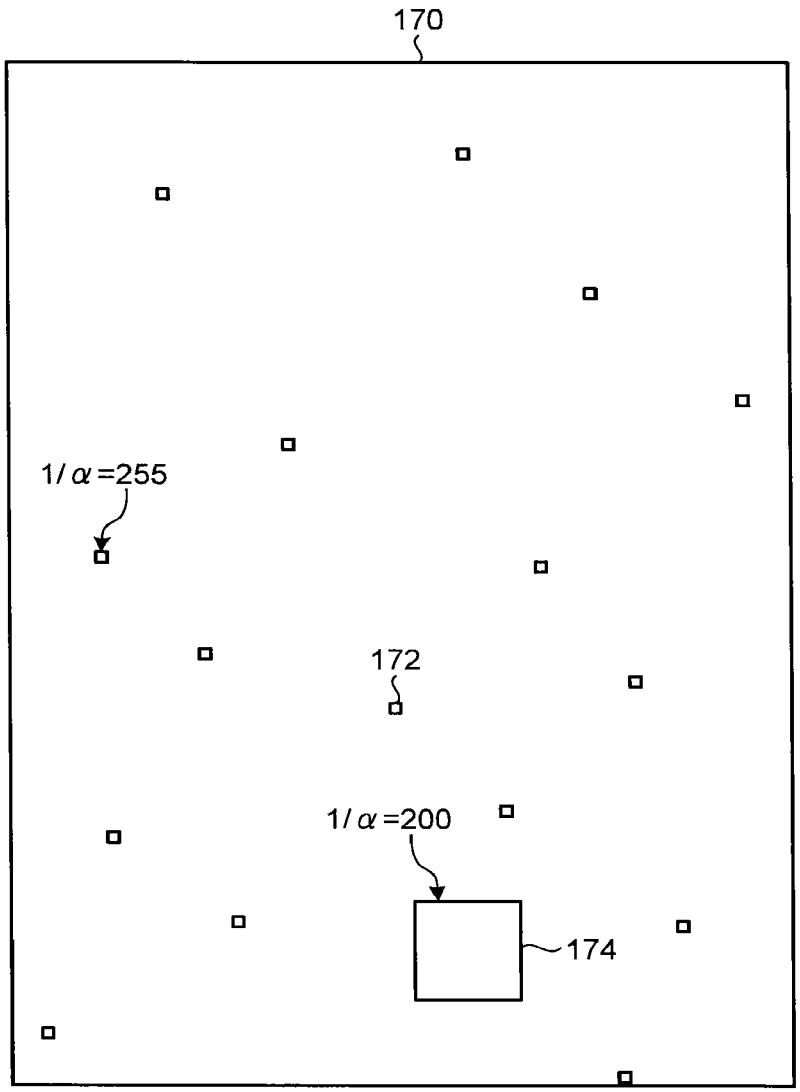
FIG. 15 is an explanatory diagram for describing an example of an irradiation amount of light of a pixel displayed on a display device.
Figure 16:
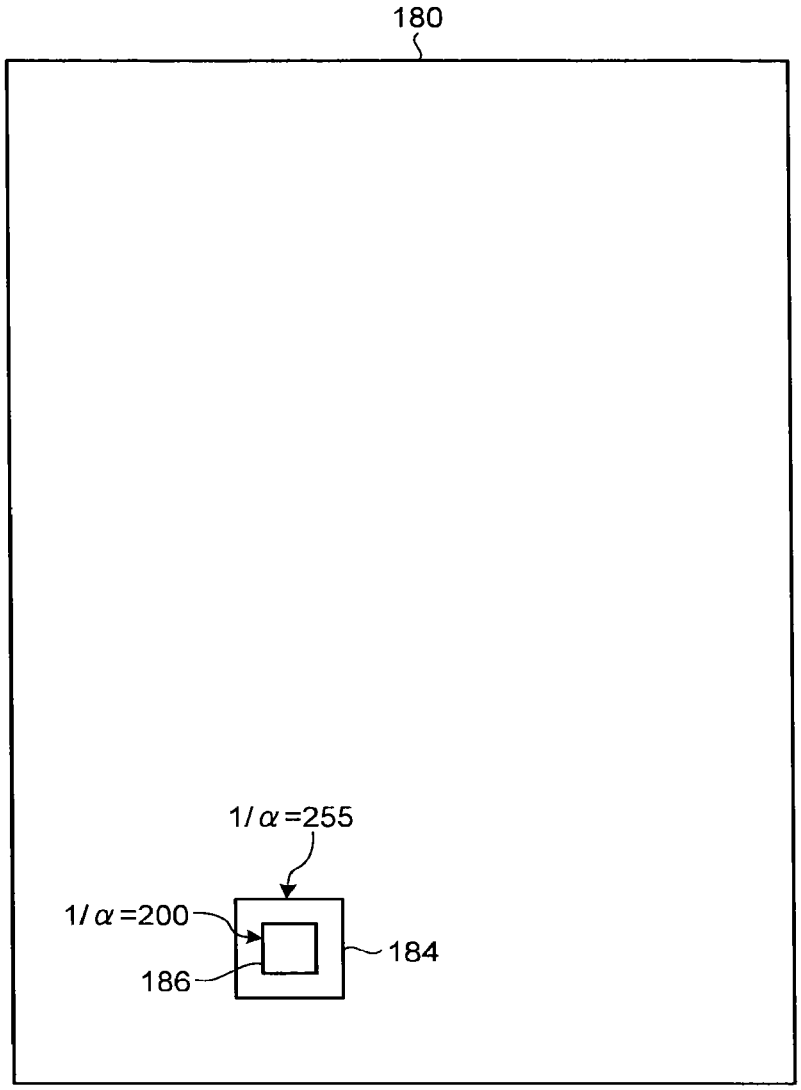
FIG. 16 is an explanatory diagram for describing an example of an irradiation amount of light of a pixel displayed on a display device.

FIGS. 15 and 16 are explanatory diagrams for describing an example of the irradiation amount of light of the pixel displayed on the display device. The display device 10 can suppress the occurrence of the deterioration in the display quality, by using the chunk index value $1/\alpha_2$ calculated by performing the chunk detection in addition to the region index value $1/\alpha_3$ calculated using a predetermined algorithm when the region light irradiation value $1/\alpha$ indicating the irradiation amount of light from the light source unit 60 is calculated. In other words, as in a region 170 illustrated in FIG. 15, when the reduction amount of electric power is reduced and the display quality is maintained by the predetermined algorithm, there is no change. Whereas as in a region 180 illustrated in FIG. 16, when the reduction amount of electric power is increased and the display quantity is deteriorated by the predetermined algorithm, the display quality can be maintained by reducing the reduction amount of electric power through the chunk detection. In the case of an image illustrated in FIG. 15, the region index value $1/\alpha_3$ is calculated in association with a predetermined number or more of pixels 172 that are dispersed, by using a predetermined algorithm. The chunk index value $1/\alpha_2$ is calculated in association with a pixel 174 (chunk) serving as an aggregate of pixels through the chunk index value calculating unit 78. As the region index value $1/\alpha_3$ has the higher value, the region index value $1/\alpha_3$ is decided as the region light irradiation value $1/\alpha$ of the region 170. In the case of an image illustrated in FIG. 16, the region index value $1/\alpha_3$ is calculated in association with a predetermined number or more of pixels 186 using a predetermined algorithm. And the chunk index value $1/\alpha_2$ is calculated in association with a pixel 184 (chunk) serving as an aggregate of pixels through the chunk index value calculating unit 78. As the chunk index value $1/\alpha_2$ has the higher value, the chunk index value $1/\alpha_2$ is decided as the region light irradiation value $1/\alpha$ of the region 180. Thus, the chunk determining unit 76 can appropriately detect a case in which the pixels that are small in number but have the high pixel index value $1/\alpha_1$ are aggregated as illustrated in FIG. 16, so as to reduce the power consumption while suppressing the deterioration in the display quality. It is possible to detect the chunk through the simple process using the determination based on the consecutiveness of the pixel.

The display device 10 determines the pixel 48, as the consecutive pixel, in which the pixel index value $1/\alpha_1$ is within a predetermined range (between the upper boundary value Up and the lower boundary value Bo) from the value of the pixel index value $1/\alpha_1$ of the starting pixel 48*s*. In other words, the display device 10 decides a boundary value for deciding whether or not the pixel is consecutive, based on the pixel index value $1/\alpha_1$ of the starting pixel 48*s*. For example, when the boundary value for deciding whether or not the pixel is consecutive is decided regardless of the pixel index value $1/\alpha_1$ of the starting pixel 48*s*, even the pixel having the pixel index value $1/\alpha_1$ close to that of the starting pixel 48*s* is determined to be inconsecutive when it is out of the range of the boundary value. However, the display device 10 decides the boundary value based on the pixel index value $1/\alpha_1$ of the starting pixel 48*s* and thus can appropriately determine whether or not a pixel having the pixel index value $1/\alpha_1$ close to the value is consecutive. Thus, the display device 10 can appropriately perform the chunk detection and reduce the power consumption while suppressing the deterioration in the display quality.

The chunk determining unit 76 performs the consecutiveness determination on the pixels in the determination direction Z from the starting pixel 48*s* sequentially along the determination direction Z. The chunk determining unit 76 determines the determination pixel 48*u* to be consecutive from the starting pixel 48*s* when the pixel index value $1/\alpha_1$ of the immediately previous pixel 48*t* serving as the pixel that has undergone the consecutiveness determination immediately before the determination pixel 48*u* is between the upper boundary value Up and the lower boundary value Bo. The pixel index value $1/\alpha_1$ of the determination pixel 48*u* is the value between the upper boundary value Up and the lower boundary value Bo. When the pixels 48 at all the sampling point from the starting pixel 48*s* to the determination pixel 48*u* are determined to be consecutive, the chunk determining unit 76 determines the determination pixel 48*u* to be consecutive. Thus, the display device 10 can more appropriately perform the consecutiveness determination.

When the pixel is determined to be inconsecutive in the consecutiveness determination, the chunk determining unit 76 suspends the consecutiveness determination, and resumes the consecutiveness determination using the pixel determined to be inconsecutive as the starting pixel. The chunk determining unit 76 newly resumes the consecutiveness determination after the consecutiveness determination is suspended and thus can detect, for example, even a plurality of groups of pixels that differ in luminance and are included in the screen as a chunk. Thus, the display device 10 can perform the chunk detection more appropriately.

The chunk index value calculating unit 78 decides the maximum value among the pixel index values $1/\alpha_1$ of the respective pixels included in the chunk as the chunk index value $1/\alpha_2$. The chunk index value calculating unit 78 can increase the value of the chunk index value $1/\alpha_2$ and thus more appropriately reduce the power consumption while suppressing the deterioration in the display quality.

Figure 17:
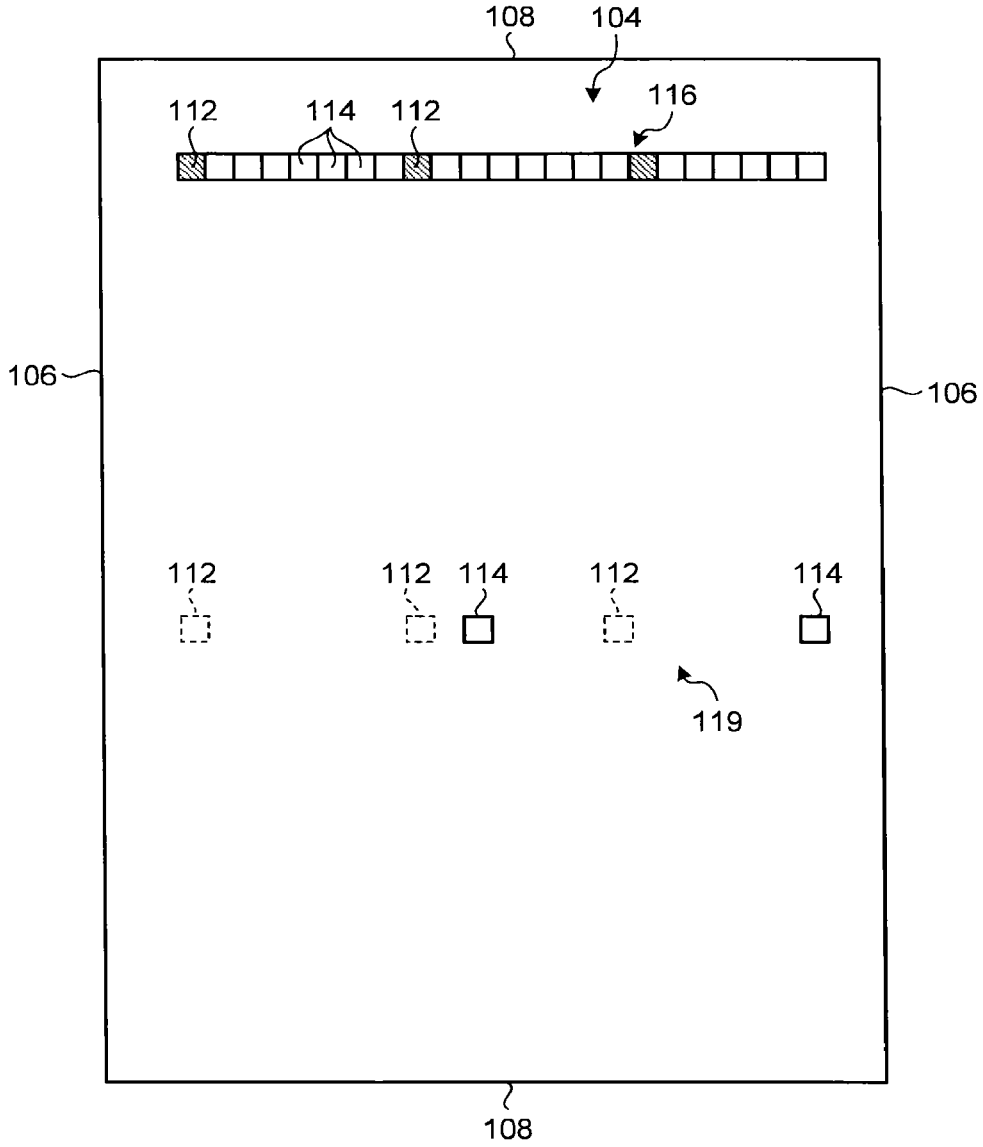
FIG. 17 is an explanatory diagram for describing when horizontal-direction chunk determination is performed.
Figure 18:
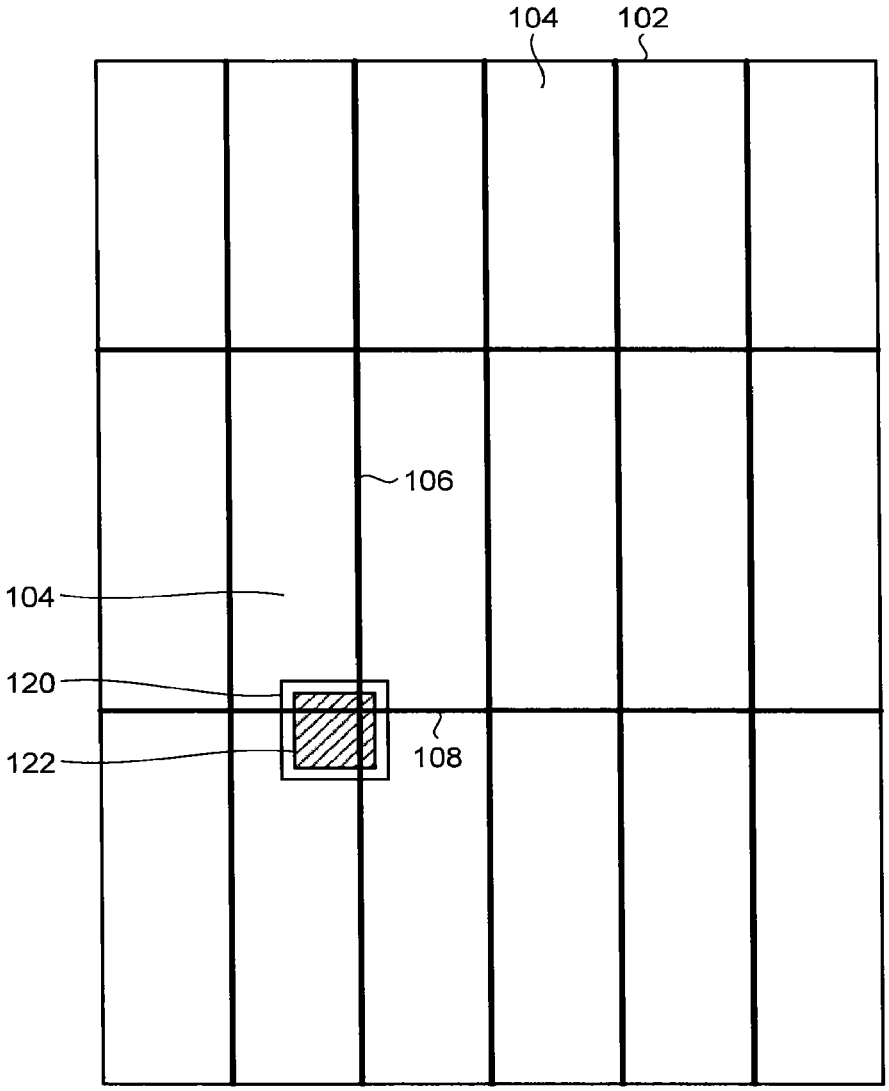
FIG. 18 is an explanatory diagram for describing when horizontal-direction chunk determination is performed.
Figure 19:
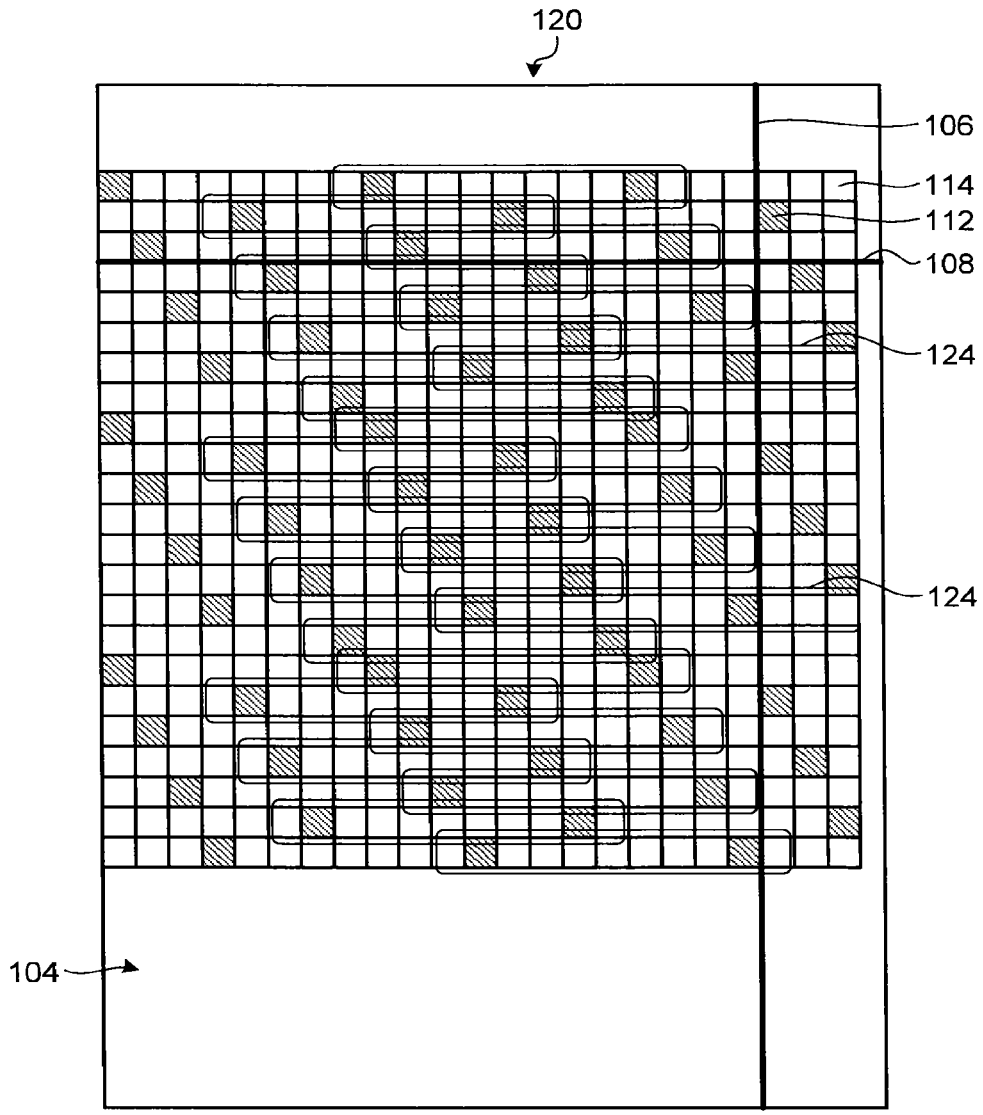
FIG. 19 is an explanatory diagram for describing an example in which horizontal-direction chunk determination is performed.

The chunk determining unit 76 performs the chunk determination in the horizontal direction. FIGS. 17 to 19 are explanatory diagrams for describing an example in which the horizontal-direction chunk determination is performed. The chunk determining unit 76 can determine a region 116 in which pixels 114 having the high pixel index value $1/\alpha_1$ are consecutive in the horizontal direction as illustrated in FIG. 17 as a chunk by performing the horizontal-direction process illustrated in FIG. 10. Specifically, the pixel index value $1/\alpha_1$ at a sampling point 112 in the region 116 is determined to be consecutive and determined as a chunk. The pixel 114 having the high pixel index value $1/\alpha_1$ is, for example, a pixel in which gradations of two color components of three colors, that is, primary colors of yellow, green, and red or RGB are high, and a gradation of the remaining one component is close to 0 (zero) in an image having a high saturation. The chunk determining unit 76 determines that there is no chunk in a region 119 in which the pixels 114 having the high pixel index value $1/\alpha_1$ are inconsecutive as illustrated in FIG. 17 by performing the horizontal-direction process illustrated in FIG. 10.

FIG. 18 illustrates an example in which a chunk 122 in which the pixels 114 having the high pixel index value $1/\alpha_1$ are aggregated straddles a plurality of regions 104 surrounded by a range 120. FIG. 19 is an enlarged view of the range 120. The chunk determining unit 76 performs the horizontal-direction process illustrated in FIG. 10 and holds the pixel index value $1/\alpha_1$ and the flag even after it has reached the boundary in the horizontal direction. Thus, even when the chunk 122 extends from the neighboring regions 104 as illustrated in FIGS. 18 and 19, the chunk determination result is held to be beyond the parting line 106 in the horizontal direction as indicated by a solid line 124, and thus the chunk in the adjacent region 104 can reliably be detected.

Figure 20:
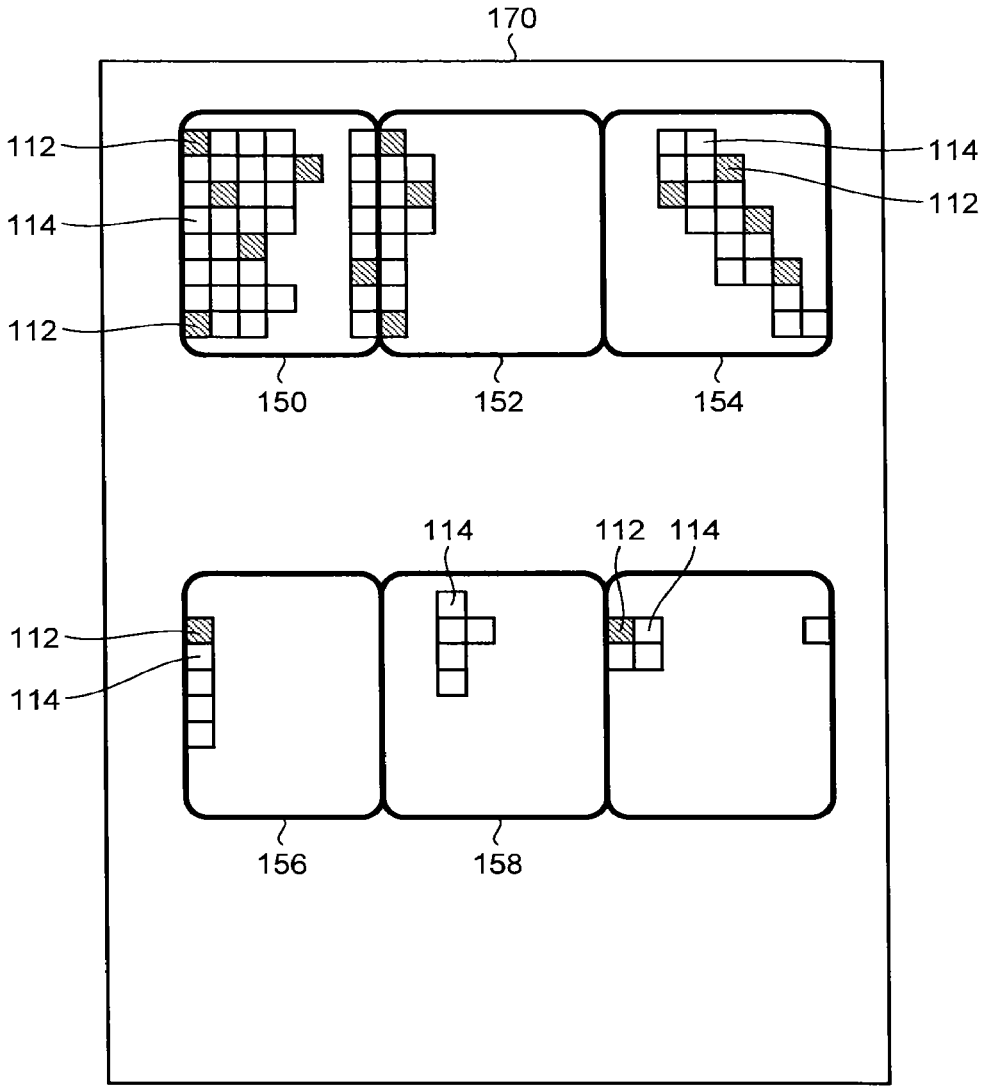
FIG. 20 is an explanatory diagram for describing an example in which vertical-direction chunk determination is performed.

The chunk determining unit 76 performs the chunk determination in the vertical direction. FIG. 20 is an explanatory diagram for describing an example in which the vertical-direction chunk determination is performed. The chunk determining unit 76 can determine that a chunk of regions 150, 152, and 154 in which the pixels 114 having the high pixel index value $1/\alpha_1$ are consecutive in the vertical direction as illustrated in FIG. 20 is a chunk by performing the vertical-direction process illustrated in FIG. 11. The chunk determining unit 76 determines that regions 156, 158, and 158 in which the pixels 114 having the high pixel index value $1/\alpha_1$ are inconsecutive in the vertical direction are not a chunk by performing the process illustrated in FIG. 11.

Second Embodiment

Next, a second embodiment will be described. A display device 10A according to the second embodiment differs from that of the first embodiment in a determination method of the consecutiveness determination. In the second embodiment, a description of portions common to those of the first embodiment will be omitted.

The chunk determining unit 76 arranged in the display device 10A according to the second embodiment differs from the chunk determining unit 76 according to the first embodiment in the consecutiveness determination value for the consecutiveness determination. The consecutiveness determination value according to the first embodiment includes the upper boundary value Up and the lower boundary value Bo. But the consecutiveness determination value according to the second embodiment includes a temporary boundary value Te, an upper limit boundary value $L_{up}$, and a lower limit boundary value $L_{bo}$ in addition to the upper boundary value Up and the lower boundary value Bo.

The chunk determining unit 76 calculates the upper boundary value Up and the lower boundary value Bo based on the pixel index value $1/\alpha_1$ of the starting pixel 48*s* through the same method as in the first embodiment. When there is an immediately previous pixel 48*t* that has undergone the consecutiveness determination immediately before the determination pixel 48*u*, the chunk determining unit 76 calculates the temporary boundary value Te based on the pixel index value $1/\alpha_1$ of the immediately previous pixel 48*t*. The temporary boundary value Te is a value that is out of the range between the upper boundary value Up and the lower boundary value Bo and differs from the pixel index value $1/\alpha_1$ of the immediately previous pixel 48*t* by a predetermined value A3. The predetermined value A3 is a previously set value that is equal to the predetermined values A1 and A2, serving as the difference between the upper boundary value Up and the pixel index value $1/\alpha_1$ of the starting pixel 48*s*, and the difference between the lower boundary value Bo and the pixel index value $1/\alpha_1$ of the starting pixel 48*s*. But the predetermined value A3 is not limited thereto and may be a different value or may be changed, for example, according to a setting of an operator or the like.

The chunk determining unit 76 decides a value larger than the upper boundary value Up as the temporary boundary value Te, when the pixel index value $1/\alpha_1$ of the immediately previous pixel 48*t* is larger than the pixel index value $1/\alpha_1$ of the starting pixel 48*s*. The chunk determining unit 76 decides a value smaller than the lower boundary value Bo as the temporary boundary value Te when the pixel index value $1/\alpha_1$ of the immediately previous pixel 48*t* is smaller than the pixel index value $1/\alpha_1$ of the starting pixel 48*s*.

Although the pixel index value $1/\alpha_1$ of the determination pixel 48*u* is not the value between the upper boundary value Up and the lower boundary value Bo, when the pixel index value $1/\alpha_1$ of the determination pixel 48*u* is the value between the pixel index value $1/\alpha_1$ of the immediately previous pixel 48*t* and the temporary boundary value Te, the chunk determining unit 76 determines the determination pixel 48*u* to be the pixel consecutive to the starting pixel 48*s*. In further detail, when the temporary boundary value Te is a value larger than the upper boundary value Up (the pixel index value $1/\alpha_1$ of the immediately previous pixel 48*t* is larger than the pixel index value $1/\alpha_1$ of the starting pixel 48*s*), the chunk determining unit 76 determines the determination pixel 48*u* to be the pixel consecutive to the starting pixel 48*s*, if the pixel index value $1/\alpha_1$ of the determination pixel 48*u* is a value between the lower boundary value Bo and the temporary boundary value Te (equal to or larger than the lower boundary value Bo and equal to or less than the temporary boundary value Te). When the temporary boundary value Te is a value larger than the lower boundary value Bo (the pixel index value $1/\alpha_1$ of the immediately previous pixel 48*t* is smaller than the pixel index value $1/\alpha_1$ of the starting pixel 48*s*), the chunk determining unit 76 determines the determination pixel 48*u* to be the pixel consecutive to the starting pixel 48*s*, if the pixel index value $1/\alpha_1$ of the determination pixel 48*u* is a value between the upper boundary value Up and the temporary boundary value Te (equal to or larger than the temporary boundary value Te and equal to or less than the upper boundary value Up).

As described above, the temporary boundary value Te is an extended boundary value that is applied only to the pixel 48 that undergoes the consecutiveness determination after the immediately previous pixel 48*t*, based on the pixel index value $1/\alpha_1$ of the immediately previous pixel 48*t*. Since the temporary boundary value Te is calculated based on the pixel index value $1/\alpha_1$ of the immediately previous pixel 48*t*, the temporary boundary value Te may differ according to the sampling point.

In addition, the chunk determining unit 76 calculates the upper limit boundary value $L_{up}$ and the lower limit boundary value $L_{bo}$ based on the pixel index value $1/\alpha_1$ of the starting pixel 48*s*. The upper limit boundary value $L_{up}$ is a value larger than the upper boundary value Up, and the lower limit boundary value $L_{bo}$ is a value smaller than the lower boundary value Bo. The chunk determining unit 76 decides a value larger than the upper boundary value Up by a predetermined value A4 as the upper limit boundary value $L_{up}$. The chunk determining unit 76 decides a value smaller than the lower boundary value Bo by a predetermined value A5 as the lower limit boundary value $L_{bo}$. The predetermined values A4 and A5 are a previously set value that is equal to the predetermined values A1 and A2, but the predetermined values A4 and A5 are not limited thereto and may be a different value or may be changed, for example, a setting or an operator or the like.

Although the pixel index value $1/\alpha_1$ of the determination pixel 48*u* is the value between the pixel index value $1/\alpha_1$ of the immediately previous pixel 48*t* and the temporary boundary value Te, when the pixel index value $1/\alpha_1$ of the determination pixel 48*u* is a value out of the range between the upper limit boundary value $L_{up}$ and the lower limit boundary value $L_{bo}$ (equal to or larger than the lower limit boundary value $L_{bo}$ and equal to or less than the upper limit boundary value $L_{up}$), the chunk determining unit 76 determines the determination pixel 48*u* to be inconsecutive to the starting pixel 48*s*. In other words, the chunk determining unit 76 increases the consecutiveness determination range through the temporary boundary value Te, while limiting an upper limit value and a lower limit value of an increased consecutiveness determination to the upper limit boundary value $L_{up}$ and the lower limit boundary value $L_{bo}$.

Figure 21:
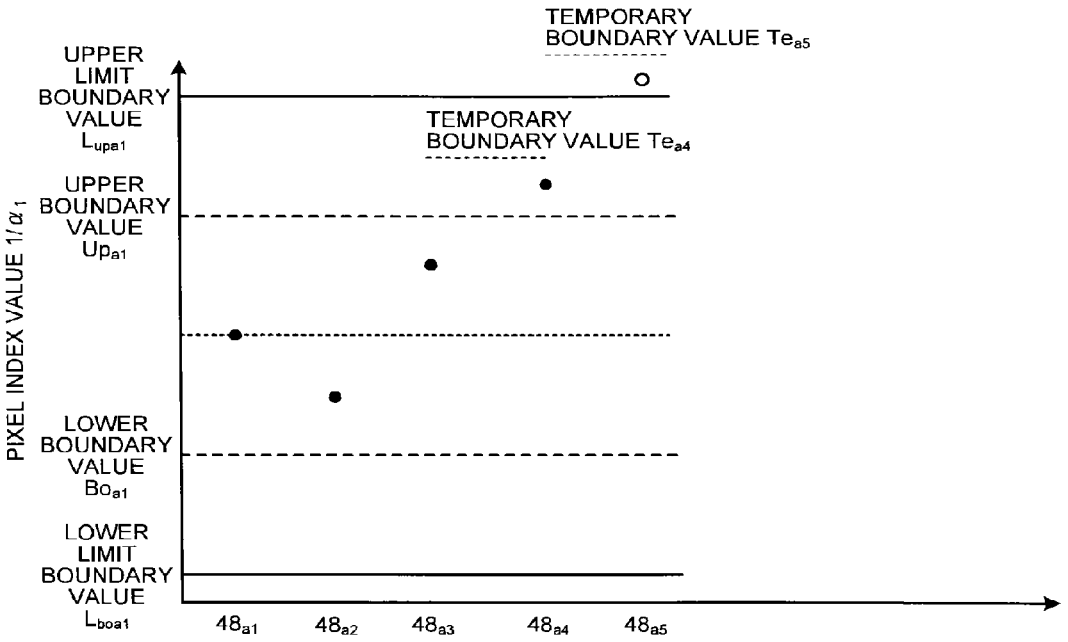
FIG. 21 is an explanatory diagram illustrating an example for describing consecutiveness determination according to the second embodiment.

FIG. 21 is an explanatory diagram illustrating an example for describing the consecutiveness determination according to the second embodiment. An example of the consecutiveness determination according to the second embodiment will be described with reference to FIG. 21. In FIG. 21, a horizontal axis indicates each pixel 48 at the sampling point, and a vertical axis indicates the pixel index value $1/\alpha_1$ of each pixel 48 at the sampling point. In other words, FIG. 21 illustrates the pixel index value $1/\alpha_1$ of each pixel 48 at the sampling point, similarly to FIG. 8.

When the consecutiveness determination is performed by selecting the pixel $\mathbf{48}_{a1}$ as the starting pixel 48*s* as illustrated in FIG. 21, the chunk determining unit 76 calculates the upper boundary value $Up_{a1}$ and the lower boundary value $Bo_{a1}$, an upper limit boundary value $L_{upa1}$, and a lower limit boundary value $L_{boa1}$ of the pixel $\mathbf{48}_{a1}$, based on the pixel index value $1/\alpha_1$ of the pixel $\mathbf{48}_{a1}$.

The chunk determining unit 76 determines whether or not the pixel at each sampling point is consecutive to the pixel $\mathbf{48}_{a1}$ in the determination direction Z of the pixel $\mathbf{48}_{a1}$. The pixels $\mathbf{48}_{a2}$ and $\mathbf{48}_{a3}$ are consecutive to the pixel $\mathbf{48}_{a1}$ since the pixel index value $1/\alpha_1$ is a value between the upper boundary value $Up_{a1}$ and the lower boundary value $Bo_{a1}$ of the pixel $\mathbf{48}_{a1}$.

On the other hand, in the pixel $\mathbf{48}_{a4}$, the pixel index value $1/\alpha_1$ is larger than the upper boundary value $Up_{a1}$. The pixel index value $1/\alpha_1$ of the pixel $\mathbf{48}_{a4}$ is a value that is equal to or less than a temporary boundary value $Te_{a4}$ calculated based on the pixel index value $1/\alpha_1$ of the pixel $\mathbf{48}_{a3}$ serving as the immediately previous pixel and equal to or less than the upper limit boundary value $L_{upa1}$. Thus, the pixel index value $1/\alpha_1$ of the pixel $\mathbf{48}_{a4}$ is not the value between the upper boundary value $Up_{a1}$ and the lower boundary value $Bo_{a1}$, but the value between the pixel index value $1/\alpha_1$ of the pixel $\mathbf{48}_{a3}$ and the temporary boundary value $Te_{a4}$, the pixel $\mathbf{48}_{a4}$ is determined to be consecutive to the pixel $\mathbf{48}_{a1}$.

The pixel index value $1/\alpha_1$ of the pixel $\mathbf{48}_{a5}$ is a value that is larger than the upper boundary value $Up_{a1}$ and equal to or less than a temporary boundary value $Te_{a5}$ calculated based on the pixel index value $1/\alpha_1$ of the pixel $\mathbf{48}_{a4}$ serving as the immediately previous pixel. The pixel index value $1/\alpha_1$ of the pixel $\mathbf{48}_{a5}$ is larger than the upper limit boundary value $L_{upa1}$. In other words, since the pixel index value $1/\alpha_1$ of the pixel $\mathbf{48}_{a5}$ is the value between the pixel index value $1/\alpha_1$ of the pixel $\mathbf{48}_{a4}$ and the temporary boundary value $Te_{a5}$ but not the value between the upper limit boundary value $L_{upa1}$ and the lower limit boundary value $L_{boa1}$, the pixel $\mathbf{48}_{a5}$ is determined to be inconsecutive to the pixel $\mathbf{48}_{a1}$. Even when the pixel index value $1/\alpha_1$ is the value between the upper limit boundary value $L_{upa1}$ and the lower limit boundary value $L_{boa1}$ or even when the pixel index value $1/\alpha_1$ is not the value between the pixel index value $1/\alpha_1$ of the immediately previous pixel 48 and the temporary boundary value Te, the pixel is determined to be inconsecutive.

The chunk determining unit 76 determines pixels from the pixels $\mathbf{48}_{a1}$ to the pixel $\mathbf{48}_{a4}$ to be consecutive, determines the pixel $\mathbf{48}_{a5}$ to be inconsecutive, and suspends the consecutiveness determination. The chunk determining unit 76 resumes the consecutiveness determination using the pixel $\mathbf{48}_{a5}$ as the new starting pixel 48*s*.

Figure 22:
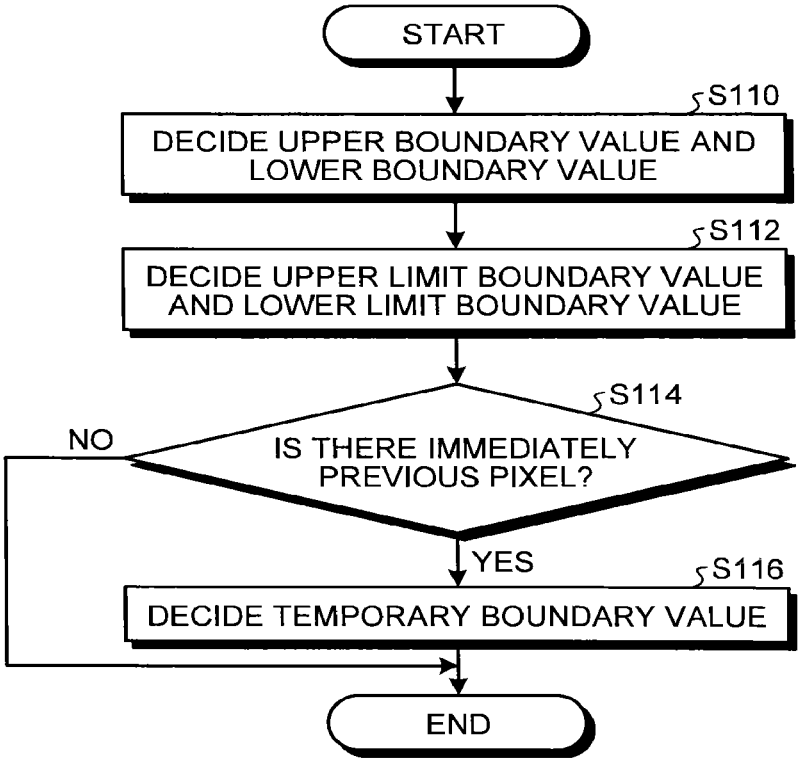
FIG. 22 is a flowchart for describing a consecutiveness determination value calculation method according to the second embodiment.

The above-described consecutiveness determination process according to the second embodiment will be described with reference to flowcharts. First, the consecutiveness determination value calculation method will be described. FIG. 22 is a flowchart for describing the consecutiveness determination value calculation method according to the second embodiment. FIG. 22 is a flowchart for describing the calculation method according to the second embodiment in detail in the calculation of the consecutiveness determination value in step S25 of FIG. 10 and step S65 of FIG. 11. As illustrated in FIG. 22, in the calculation of the consecutiveness determination value, the chunk determining unit 76 decides (calculates) the upper boundary value Up and the lower boundary value Bo based on the pixel index value $1/\alpha_1$ of the starting pixel 48*s* (step S110). And the chunk determining unit 76 decides (calculates) the upper limit boundary value $L_{up}$ and the lower limit boundary value $L_{bo}$ based on the pixel index value $1/\alpha_1$ of the starting pixel 48*s* (step S112). Step S112 may be performed at the same time as step S110.

After the upper limit boundary value $L_{up}$ and the lower limit boundary value $L_{bo}$ are calculated, the chunk determining unit 76 determines whether or not there is an immediately previous pixel 48*t* that has undergone the consecutiveness determination immediately before the pixel that undergoes the consecutiveness determination (step S114). When it is determined that there is the immediately previous pixel 48*t* (Yes in step S114), the chunk determining unit 76 decides (calculates) the temporary boundary value Te based on the pixel index value $1/\alpha_1$ of the immediately previous pixel 48*t* (step S116), and ends the consecutiveness determination value calculation process. Even when it is determined that there is no immediately previous pixel 48*t* (No in step S114), the chunk determining unit 76 ends the consecutiveness determination value calculation process. Step S114 may be performed only when it is determined that there is the immediately previous pixel 48*t*.

Figure 23:
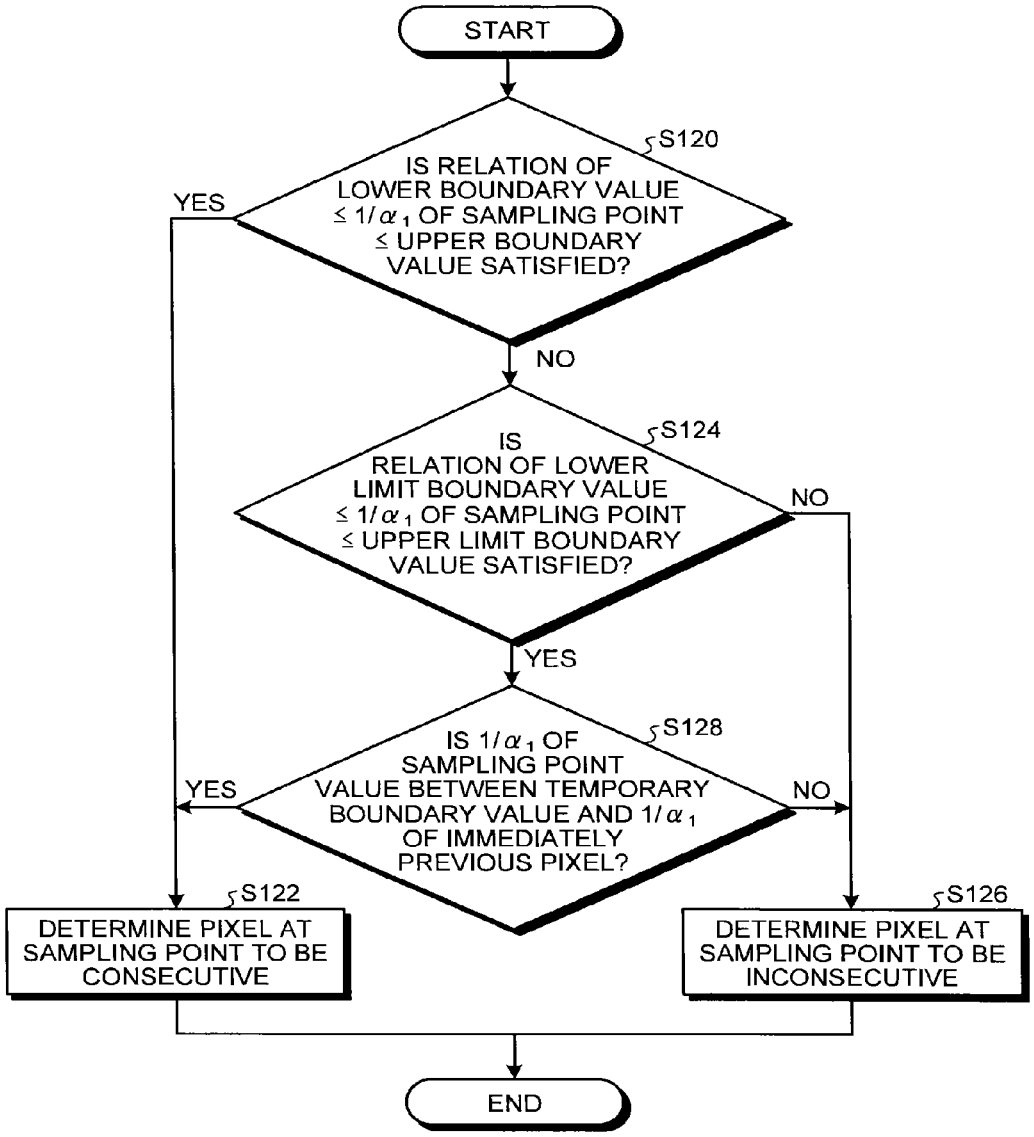
FIG. 23 is a flowchart for describing a consecutiveness determination value calculation method according to the second embodiment.

Next, the consecutiveness determination method will be described. FIG. 23 is a flowchart for describing the consecutiveness determination value calculation method according to the second embodiment. FIG. 23 is a flowchart for describing the consecutiveness determination method according to the second embodiment in detail in the consecutiveness determination method in step S28 of FIG. 10 and step S70 of FIG. 11. As illustrated in FIG. 23, the chunk determining unit 76 determines whether or not a relation of the lower boundary value Bo≤the pixel index value $1/\alpha_1$ of the sampling point≤the upper boundary value Up is satisfied (step S120). When the relation of the lower boundary value Bo≤the pixel index value $1/\alpha_1$ of the sampling point≤the upper boundary value Up is satisfied (Yes in step S120), the chunk determining unit 76 determines the pixel at the sampling point to be consecutive (step S122), and then ends the process.

When the relation of the lower boundary value Bo≤the pixel index value $1/\alpha_1$ of the sampling point≤the upper boundary value Up is determined to be not satisfied (No in step S120), the chunk determining unit 76 determines whether or not a relation of the lower limit boundary value $L_{bo}$≤the pixel index value $1/\alpha_1$ of the sampling point≤the upper limit boundary value $L_{up}$ is satisfied (step S124). When the relation of the lower limit boundary value $L_{bo}$≤the pixel index value $1/\alpha_1$ of the sampling point≤the upper limit boundary value $L_{up}$ is not satisfied (No in step S124), the chunk determining unit 76 determines the pixel at the sampling point to be inconsecutive (step S126), and then ends the process.

When the relation of the lower limit boundary value $L_{bo}$≤the pixel index value $1/\alpha_1$ of the sampling point≤the upper limit boundary value $L_{up}$ is satisfied (Yes in step S124), the chunk determining unit 76 determines whether or not the pixel index value $1/\alpha_1$ of the sampling point is a value between the temporary boundary value Te and the pixel index value $1/\alpha_1$ of the immediately previous pixel 48*t* (step S128). When the pixel index value $1/\alpha_1$ of the sampling point is the value between the temporary boundary value Te and the pixel index value $1/\alpha_1$ of the immediately previous pixel 48*t* (Yes in step S128), the chunk determining unit 76 determines the pixel at the sampling point to be consecutive (step S122), and then ends the process. When the pixel index value $1/\alpha_1$ of the sampling point is not the value between the temporary boundary value Te and the pixel index value $1/\alpha_1$ of the immediately previous pixel 48*t* (No in step S128), the chunk determining unit 76 determines the pixel at the sampling point to be inconsecutive (step S126), and then ends the process.

As described above, the chunk determining unit 76 of the display device 10A according to the second embodiment determines the determination pixel 48*u* to be consecutive from the starting pixel 48*s*, when the pixel index value $1/\alpha_1$ of the determination pixel 48*u* is a value between the pixel index value $1/\alpha_1$ of the immediately previous pixel 48*t* and the temporary boundary value Te. When the pixel index value $1/\alpha_1$ of the determination pixel 48*u* is not the value between the upper boundary value Up and the lower boundary value Bo but the value within the range of the temporary boundary value Te, the chunk determining unit 76 determines the determination pixel 48*u* to be consecutive. When the pixel index value $1/\alpha_1$ is the value that is apart from the starting pixel 48*s* but close to the pixel index value $1/\alpha_1$ of the immediately previous pixel 48*t* that has undergone the consecutiveness determination immediately previously, the chunk determining unit 76 determines the pixel to be consecutive. Thus, the chunk determining unit 76 can more appropriately perform the chunk detection.

The temporary boundary value Te is the value larger than the upper boundary value Up when the pixel index value $1/\alpha_1$ of the immediately previous pixel 48*t* is larger than the pixel index value $1/\alpha_1$ of the starting pixel 48*s*. And the temporary boundary value Te is the value smaller than the lower boundary value Bo when the pixel index value $1/\alpha_1$ of the immediately previous pixel 48*t* is smaller than the pixel index value $1/\alpha_1$ of the starting pixel 48*s*. The chunk determining unit 76 can appropriately increase the value range of the pixel index value $1/\alpha_1$ determined to be consecutive through the temporary boundary value Te and thus can more appropriately perform the chunk detection.

The chunk determining unit 76 determines the determination pixel 48*u* to be inconsecutive from the starting pixel 48*s*, when the pixel index value $1/\alpha_1$ of the determination pixel 48*u* is the value that is between the pixel index value $1/\alpha_1$ of the immediately previous pixel 48*t* and the temporary boundary value Te, but out of the range between the lower limit boundary value $L_{bo}$ and the upper limit boundary value $L_{up}$. The chunk determining unit 76 increases the value range of the pixel index value $1/\alpha_1$ determined to be consecutive through the temporary boundary value Te and limits the lower limit boundary value $L_{bo}$ and the upper limit boundary value $L_{up}$. The chunk determining unit 76 can increase the value range of the pixel index value $1/\alpha_1$ determined to be consecutive to an appropriate range and thus can more appropriately perform the chunk detection.

Third Embodiment

Next, a third embodiment will be described. A display device 10B according to the third embodiment differs from that of the first embodiment in the calculation method of the chunk index value $1/\alpha_2$. In the third embodiment, a description of portions common to those of the first embodiment will be omitted.

A chunk index value calculating unit 78B arranged in the display device 10B according to the third embodiment decides a value between a maximum value and a minimum value of the pixel index values $1/\alpha_1$ of all the pixels 48 included in the chunk, as the chunk index value $1/\alpha_2$. In further detail, the chunk index value calculating unit 78B calculates the chunk index value $1/\alpha_2$ of the chunk based on an average of the pixel index values $1/\alpha_1$ of all the pixels 48 included in the chunk. Specifically, the chunk index value calculating unit 78B decides an addition average value of the pixel index values $1/\alpha_1$ of all the pixels 48 included in the chunk as the chunk index value $1/\alpha_2$ of the chunk as indicated in the following Equation (8).

$$1/\alpha_2 = \sum_{k=1}^{n} \frac{(1/\alpha_{1ak})}{n} \tag{8}$$

In Equation (8), n indicates the number of pixels 48 included in the chunk, that is, the number of pixels determined to be consecutive including the starting pixel 48*s*. In Equation (8), $1/\alpha_{1ak}$ indicates the pixel index value $1/\alpha_1$ of any one of the pixels 48 of the chunk including the starting pixel 48*s*.

The chunk index value calculating unit 78B decides the addition average value of the pixel index values $1/\alpha_1$ of all the pixels 48 included in the chunk as the chunk index value $1/\alpha_2$ of the chunk as described above. But the present invention is not limited thereto, and, for example, a value obtained by adding a predetermined coefficient to the addition average value or by multiplying the addition average value by a predetermined coefficient or a value calculated using any other averaging process may be decided as the chunk index value $1/\alpha_2$ of the chunk.

The chunk index value calculating unit 78B preferably decide the value between the maximum value and the minimum value of the pixel index values $1/\alpha_1$ of all the pixels 48 included in the chunk, as the chunk index value $1/\alpha_2$ of the chunk. The chunk index value calculating unit 78B may calculates the chunk index value $1/\alpha_2$ based on a differential average value calculated by averaging differences between the pixel index value $1/\alpha_1$ of the determination pixel 48*u* and the pixel index value $1/\alpha_1$ of the starting pixel 48*s*, and the pixel index value $1/\alpha_1$ of the starting pixel, for example. Here, the differential average value is a value obtained by calculating the difference value between the pixel index value $1/\alpha_1$ of the determination pixel 48*u* and the pixel index value $1/\alpha_1$ of the starting pixel 48*s* for each of the pixels 48 included in the chunk, and averaging the difference values. The chunk index value calculating unit 78B calculates the chunk index value $1/\alpha_2$ by adding the differential average value to the pixel index value $1/\alpha_1$ of the starting pixel, for example. Specifically, the chunk index value calculating unit 78B calculates the chunk index value $1/\alpha_2$ based on the following Equation (9), for example.

$$1/\alpha_2 = 1/\alpha_{1a0} + \sum_{k=1}^{n} \frac{(1/\alpha_{1ak} - 1/\alpha_{1a0})}{2m} \tag{9}$$

$1/\alpha_{1a0}$ in Equation (9) indicates the pixel index value $1/\alpha_1$ of the starting pixel 48*s*, and $1/\alpha_{1ak}$ in Equation (9) indicates the pixel index value $1/\alpha_1$ of any one of the pixels 48 of the chunk including no starting pixel 48*s*. In Equation (9), m indicates a value indicated by the following Equation (10).

$$m=1 \text{ (when } n=1)$$

$$m=2^N \text{ (when } n\geq 2) \tag{10}$$

In Equation (10), N indicates a value indicated by the following Equation (11).

$$N=\text{Ceiling}(\sqrt{n}) \tag{11}$$

In Equation (11), a function Ceiling(x) is a ceiling function for calculating a maximum integer having a value that does not exceed x. In other words, in Equation (11), N is a maximum integer that does not exceed a square root of n.

As described above, the chunk index value calculating unit 78B uses a value of each factorial of 2 as m when the chunk index value $1/\alpha_2$ of the chunk is calculated based on Equation (9). Thus, the chunk index value calculating unit 78B can suppress an operation capacity when the chunk index value $1/\alpha_2$ of the chunk is calculated based on Equation (9). When the number of consecutive pixels 48 is a predetermined number or more (when n is a predetermined value or more), the chunk index value calculating unit 78B may calculate the chunk index value $1/\alpha_2$ using Equation (9) for the pixels 48 corresponding to the predetermined number or less. And the chunk index value calculating unit 78B may decide the chunk index value $1/\alpha_2$ as the chunk index value $1/\alpha_2$ of the chunk. In this case, the predetermined number is, for example, 63 but not limited thereto. In this case, the chunk index value calculating unit 78B can suppress the increase in an operand and thus suppress an operation capacity. In addition, since the operation is performed up to the predetermined number, a reduction in operation accuracy can be suppressed. In the chunk index value calculating unit 78B, the calculation method of the chunk index value $1/\alpha_2$ is not limited to Equation (9) as long as the chunk index value $1/\alpha_2$ is calculated based on the differential average value and the pixel index value $1/\alpha_1$ of the starting pixel.

As described above, the chunk index value calculating unit 78B decides the value between the maximum value and the minimum value of the pixel index values $1/\alpha_1$ of all the pixels 48 included in the chunk, as the chunk index value $1/\alpha_2$ of the chunk. The chunk index value calculating unit 78B calculates the chunk index value $1/\alpha_2$ of the chunk based on the values of the pixel index values $1/\alpha_1$ of all the pixels 48 included in the chunk and thus can more appropriately reduce the power consumption while suppressing the deterioration in the display quality.

The chunk index value calculating unit 78B calculates the chunk index value $1/\alpha_2$ based on the average of the pixel index values $1/\alpha_1$ of the pixels 48 of the chunk. The chunk index value calculating unit 78B calculates the chunk index value $1/\alpha_2$ of the chunk based on the average of the pixel index values $1/\alpha_1$ of all the pixels 48 included in the chunk and thus can more appropriately reduce the power consumption while suppressing the deterioration in the display quality.

The chunk index value calculating unit 78B may calculate the chunk index value $1/\alpha_2$ based on the differential average value, which is calculated by averaging the differences between the pixel index values $1/\alpha_1$ of the pixels 48 of the chunk and the pixel index value $1/\alpha_1$ of the starting pixel 48*s*, and the pixel index value $1/\alpha_1$ of the starting pixel 48*s*. The chunk index value calculating unit 78B calculates the chunk index value $1/\alpha_2$ of the chunk based on the differential average value and thus can more appropriately reduce the power consumption while suppressing the deterioration in the display quality.

Application Examples

Figure 24:
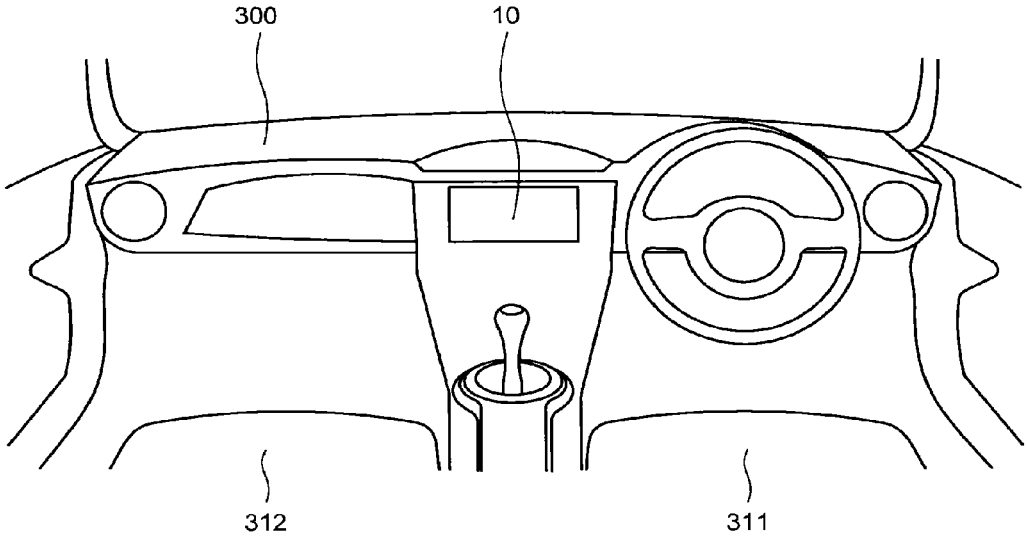
FIG. 24 is a diagram illustrating an example of an electronic apparatus to which the display device according to the first embodiment is applied.
Figure 25:
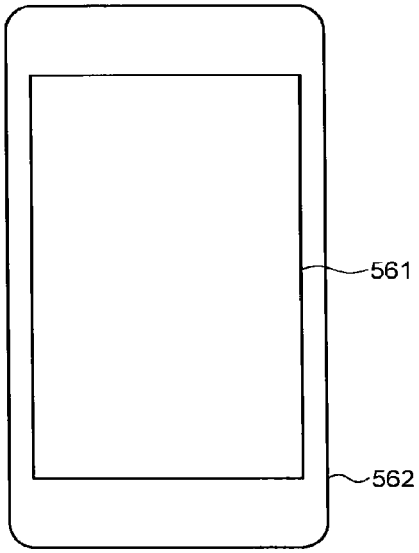
FIG. 25 is a diagram illustrating an example of an electronic apparatus to which the display device according to the first embodiment is applied.

Next, an application example of the display device 10 according to the first embodiment will be described with reference to FIGS. 24 and 25. FIGS. 24 and 25 are diagrams illustrating an example of an electronic apparatus to which the display device according to the first embodiment is applied. The display device 10 according to the first embodiment is applicable to electronic apparatuses of all fields such as car navigation systems illustrated in FIG. 24, television apparatuses, digital cameras, laptop personal computers, portable electronic apparatuses such as a mobile phone illustrated in FIG. 25, or video cameras. In other words, the display device 10 according to the first embodiment is applicable to electronic apparatuses of all fields that display video signals input from the outside or internally generated video signals as an image or video. The electronic apparatus includes the control device 11 (see FIG. 1) that supplies the video signals to the display device and controls the operation of the display device. The present application example may also be applicable to the display devices according to the other embodiments described above in addition to the display device 10 according to the first embodiment.

The electronic apparatus illustrated in FIG. 24 is a car navigation apparatus to which the display device 10 according to the first embodiment is applied. The display device 10 is installed on a dashboard 300 in a vehicle. Specifically, the display device 10 is installed on a portion of the dashboard 300 between a driver seat 311 and a passenger seat 312. The display device 10 of the car navigation apparatus is used to perform a navigation display, a music operation screen display, a video reproduction display, or the like.

An electronic apparatus illustrated in FIG. 25 is a portable information terminal to which the display device 10 according to the first embodiment is applied and that operates as a mobile computer, a multi-functional mobile phone, a mobile computer with a voice call function, or a mobile computer with a communication function and is also called a smartphone or a tablet terminal. The portable information terminal includes a display unit 561 on the surface of a housing 562, for example. The display unit 561 includes the display device 10 according to the first embodiment and a touch detection (so-called a touch panel) function capable of detecting an external proximity object.

The exemplary embodiments according to the present invention have been described above, but the embodiments are not limited to content thereof. The components described above include components that are easily conceivable by those skilled in the art, substantially the same components, and equivalent ones. The components described above can appropriately be combined as well. In addition, various omissions, replacements or changes of the components can be made without departing from the gist of the embodiments described above.

What is claimed is:

1. A display device, comprising:

an image display panel including a plurality of pixels arranged in a matrix form;

a light source unit that irradiates the image display panel with light; and a signal processing unit that controls the pixels based on an input signal of an image, and controls an irradiation amount of light of the light source unit, wherein the signal processing unit includes a pixel index value calculating unit that calculates a pixel index value serving as an index for obtaining the irradiation amount of the light emitted from the light source unit based on the input signal for each pixel, a chunk determining unit that performs consecutiveness determination which determines whether or not a pixel, having a pixel index value between an upper boundary value larger than a pixel index value of a starting pixel and a lower boundary value smaller than the pixel index value of the starting pixel, is consecutive from the starting pixel, and determines a region of consecutive pixels as a chunk, a chunk index value calculating unit that calculates a chunk index value serving as an index value of the chunk based on the pixel index values of the pixels of the chunk, a region index value calculating unit that calculates a region index value serving as an index value of an entire target region based on the pixel index values of all the pixels of the target region, and a light irradiation amount deciding unit that compares the chunk index value with the region index value, and decides the irradiation amount of the light of the light source unit in the target region based on one of the chunk index value and the region index value by which the irradiation amount of the light is increased.

2. The display device according to claim 1, wherein the chunk determining unit performs the consecutiveness determination on the pixels in a predetermined direction from the starting pixel sequentially along the predetermined direction, and, determines a certain pixel to be consecutive from the starting pixel when a pixel index value of an immediately previous pixel which has undergone the consecutiveness determination immediately before the certain pixel is between the upper boundary value and the lower boundary value, and a pixel index value of the certain pixel is between the upper boundary value and the lower boundary value.

3. The display device according to claim 2, wherein, when a pixel is determined to be inconsecutive in the consecutiveness determination, the chunk determining unit suspends the consecutiveness determination, and resumes the consecutiveness determination setting the pixel determined to be inconsecutive as a new starting pixel.

4. The display device according to claim 2, wherein, the chunk determining unit determines the certain pixel to be consecutive from the starting pixel, when the pixel index value of the certain pixel differs from the pixel index value of the immediately previous pixel by a certain value, and is a value between a temporary boundary value, serving as a value out of a range between the upper boundary value and the lower boundary value, and the pixel index value of the immediately previous pixel.

5. The display device according to claim 4, wherein the temporary boundary value is larger than the upper boundary value when the pixel index value of the immediately previous pixel is larger than the pixel index value of the starting pixel, and the temporary boundary value is smaller than the lower boundary value when the pixel index value of the immediately previous pixel is smaller than the pixel index value of the starting pixel.

6. The display device according to claim 4, wherein, the chunk determining unit determines the certain pixel to be inconsecutive from the starting pixel, when the pixel index value of the certain pixel is a value that is between the pixel index value of the immediately previous pixel and the temporary boundary value, but out of a range between an upper limit boundary value larger than the upper boundary value and a lower limit boundary value smaller than the lower boundary value.

7. The display device according to claim 1, wherein the chunk index value calculating unit decides a maximum value of the pixel index values of the pixels of the chunk as the chunk index value.

8. The display device according to claim 1, wherein the chunk index value calculating unit decides a value between a maximum value and a minimum value of the pixel index values of the pixels of the chunk as the chunk index value.

9. The display device according to claim 8, wherein the chunk index value calculating unit decides the chunk index value based on an average of the pixel index values of the pixels of the chunk.

10. The display device according to claim 8, wherein the chunk index value calculating unit calculates the chunk index value based on a differential average value, which is calculated by averaging differences between the pixel index values of the pixels of the chunk and the pixel index value of the starting pixel, and the pixel index value of the starting pixel.

11. The display device according to claim 1, wherein, the chunk determining unit performs the consecutiveness determination using the starting pixel as a starting point, when the pixel index value of the starting pixel is a predetermined value or more.

12. An electronic apparatus, comprising:

the display device according to claim 1.

13. A method of driving a display device including an image display panel including a plurality of pixels arranged in a matrix form and a light source unit that irradiates the image display panel with light, the method comprising:

an input signal detection step of detecting an input signal of an image;

a pixel index value calculation step that calculates a pixel index value serving as an index for obtaining an irradiation amount of the light emitted from the light source unit based on the input signal for each pixel;

a chunk determination step that performs consecutiveness determination which determines whether or not a pixel, having a pixel index value between an upper boundary value larger than a pixel index value of a starting pixel and a lower boundary value smaller than the pixel index value of the starting pixel, is consecutive from the starting pixel and determining a region of consecutive pixels as a chunk;

a chunk index value calculation step of calculating a chunk index value serving as an index value of the chunk based on the pixel index values of the pixels of the chunk, a region index value calculation step of calculating a region index value serving as an index value of an entire target region based on the pixel index values of all the pixels of the target region;

a light irradiation amount decision step of comparing the chunk index value with the region index value and deciding the irradiation amount of the light of the light source unit in the target region based on one of the chunk index value and the region index value by which the irradiation amount of the light is increased; and a control step of controlling the irradiation amount of light of the light source unit based on the decided irradiation amount of the light.

* * * * *